US006358188B1

(12) United States Patent
Ben-Yehuda et al.

(10) Patent No.: US 6,358,188 B1
(45) Date of Patent: Mar. 19, 2002

(54) EXERCISE TRACKING SYSTEM

(75) Inventors: Ram Ben-Yehuda; Sharon Ben-Yehuda, both of Rehovot (IL)

(73) Assignee: Gym-In Ltd., Nes Ziona (IL)

( * ) Notice: Subject to any disclaimer, the term of this patent is extended or adjusted under 35 U.S.C. 154(b) by 0 days.

(21) Appl. No.: 09/232,885

(22) Filed: Jan. 15, 1999

(30) Foreign Application Priority Data

Feb. 26, 1998 (IL) ..... 123491
Nov. 5, 1998 (IL) ..... 126927

(51) Int. Cl.[7] ..... A63B 21/00

(52) U.S. Cl. ..... 482/8; 482/9; 482/92; 482/900

(58) Field of Search ..... 482/1–9, 92, 93, 482/900–902

(56) References Cited

U.S. PATENT DOCUMENTS

| | | | | |
|---|---|---|---|---|
| 4,860,763 A | | 8/1989 | Schminke | |
| 4,907,795 A | * | 3/1990 | Shaw et al. | 482/9 |
| 5,104,120 A | | 4/1992 | Watterson et al. | |
| 5,286,244 A | | 2/1994 | Wright et al. | |
| 5,410,472 A | | 4/1995 | Anderson | |
| 5,458,548 A | | 10/1995 | Crossing et al. | |
| 5,462,503 A | | 10/1995 | Benjamin et al. | |
| 5,466,200 A | | 11/1995 | Ulrich et al. | |
| 5,474,090 A | | 12/1995 | Begun et al. | |
| 5,538,007 A | | 7/1996 | Gorman | |
| 5,598,849 A | | 2/1997 | Browne | |
| 5,785,632 A | * | 7/1998 | Greenberg et al. | 482/5 |

FOREIGN PATENT DOCUMENTS

| | | |
|---|---|---|
| DE | 3807038 | 9/1989 |
| DE | 3914437 | 11/1989 |
| DE | 3822028 | 1/1990 |
| EP | 0 507 051 | 10/1992 |
| EP | 0 691 140 | 1/1996 |
| FR | 2473175 | 7/1981 |
| SU | 1461483 | 2/1989 |
| WO | WO 87/03498 | 6/1987 |
| WO | WO 87/05727 | 9/1987 |
| WO | WO 94/17860 | 8/1994 |
| WO | WO 94/21171 | 9/1994 |
| WO | WO 96/29121 | 9/1996 |
| WO | WO 97/45176 | 1/1997 |

* cited by examiner

*Primary Examiner*—Glenn E. Richman
(74) *Attorney, Agent, or Firm*—Darby & Darby

(57) ABSTRACT

This invention discloses a method for measuring exercise, the method including providing a first light reflection of an exercise apparatus, detecting a second light reflection of the exercise apparatus, and determining at least one exercise measurement from a comparison of the light reflections.

37 Claims, 23 Drawing Sheets

FIG. 14D

No. OF WEIGHTS: 2
WEIGHT LOAD: 20Kg
DISTANCE TRAVELED: 1m
SPEED: 3m/sec
ACCELERATION: $3m/sec^2$
DECELERATION: N/A
FORCE: 10 NEWTONS

EXERCISE TRACKING SYSTEM

FIELD OF THE INVENTION

The present invention relates to exercise apparatus in general, and in particular to apparatus and methods for tracking exercise.

BACKGROUND OF THE INVENTION

Exercise systems which track a user's progress on exercise equipment are known. Existing systems are disadvantageous in that they often are adapted to specific exercise equipment, are unwieldy, are difficult to install, and are often unreliable due to wear and malfunction of moving mechanical parts.

The following patent documents are believed to be representative of the art: U.S. Pat. Nos. 4,907,795, 5,458,548, and 5,598,849, PCT Patent Application Nos. PCT/US87/00527 and PCT/FR96/00333, and German Patent No. 3,807,038.

The disclosures of all publications mentioned in the specification and of the publications cited therein are hereby incorporated by reference.

SUMMARY OF THE INVENTION

The present invention seeks to provide novel apparatus and methods for tracking exercise, specifically for use with exercise equipment such as, but not limited to, weight stack lifting equipment. The present invention provides an improved system which overcomes the known disadvantages of the prior art as discussed above.

There is thus provided in accordance with a preferred embodiment of the present invention an exercise tracking system including at least one exercise apparatus, at least one light interaction member attached to the exercise apparatus, and at least one detector arranged to receive a light interaction via the light interaction member.

Further in accordance with a preferred embodiment of the present invention the system includes a light source arranged to interact with the light interaction member.

Still further in accordance with a preferred embodiment of the present invention the light source is arranged to impinge light on the light interaction member.

Additionally in accordance with a preferred embodiment of the present invention the exercise apparatus is operative to selectively position the light interaction member within and without a field of view of the detector.

Moreover in accordance with a preferred embodiment of the present invention the exercise apparatus is further operative to cyclically position the light interaction member within and without the field of view.

Further in accordance with a preferred embodiment of the present invention the at least one light interaction member includes a plurality of light interaction members.

Still further in accordance with a preferred embodiment of the present invention the at least two of the plurality of light interaction members are of different dimensions.

Additionally in accordance with a preferred embodiment of the present invention the at least one detector includes a plurality of detectors.

Moreover in accordance with a preferred embodiment of the present invention the exercise apparatus includes a weight.

Further in accordance with a preferred embodiment of the present invention the detector includes a processor operative to determine a measurement of the light interaction.

Still further in accordance with a preferred embodiment of the present invention the processor is additionally operative to determine a correlation between the measurement at least one exercise characteristic.

Additionally in accordance with a preferred embodiment of the present invention the system further includes a computer in communication with the processor.

Moreover in accordance with a preferred embodiment of the present invention the system further includes apparatus for maintaining at least one relationship between the correlation and the exercise characteristic.

Further in accordance with a preferred embodiment of the present invention the system further includes a display.

Still further in accordance with a preferred embodiment of the present invention the system further includes user identification apparatus.

Additionally in accordance with a preferred embodiment of the present invention the user identification apparatus includes a smart card.

Moreover in accordance with a preferred embodiment of the present invention the user identification apparatus includes a magnetic stripe card.

Further in accordance with a preferred embodiment of the present invention the user identification apparatus includes a card reader Still further in accordance with a preferred embodiment of the present invention the user identification apparatus includes a keypad.

Additionally in accordance with a preferred embodiment of the present invention the user identification apparatus includes a card writer.

Moreover in accordance with a preferred embodiment of the present invention the system further includes audio output apparatus.

Further in accordance with a preferred embodiment of the present invention the system further includes apparatus for maintaining exercise parameters.

Still further in accordance with a preferred embodiment of the present invention any of the light interaction members are arranged to identify the exercise apparatus.

Additionally in accordance with a preferred embodiment of the present invention the light interaction member includes a reflector.

Moreover in accordance with a preferred embodiment of the present invention the light interaction member includes a tab.

Further in accordance with a preferred embodiment of the present invention the tab is of sufficient opacity such that the light interaction thereat is not detectable by the detector.

There is also provided in accordance with a preferred embodiment of the present invention a method for measuring exercise, the method including producing at least one light interaction with an exercise apparatus, detecting the at least one light interaction, determining a correlation between the at least one light interaction and at least one exercise characteristic.

Further in accordance with a preferred embodiment of the present invention the method includes moving the exercise apparatus along an apparatus path.

Still further in accordance with a preferred embodiment of the present invention the detecting step includes detecting the at least one light interaction at at least one detector.

Additionally in accordance with a preferred embodiment of the present invention the detecting step includes detecting the at least one light interaction at a plurality of detectors positioned along a detection path that corresponds to the apparatus path.

Moreover in accordance with a preferred embodiment of the present invention the method further includes determining a direction in which the exercise apparatus is moving by detecting the at least one light interaction at a first of the plurality of detectors and subsequently detecting the at least one light interaction at a second of the plurality of detectors.

Further in accordance with a preferred embodiment of the present invention the detecting step includes measuring a duration of the light interaction.

Still further in accordance with a preferred embodiment of the present invention the method further includes correlating the duration with an identity of the exercise apparatus.

Additionally in accordance with a preferred embodiment of the present invention the method further includes correlating the duration with a speed of the exercise apparatus.

Moreover in accordance with a preferred embodiment of the present invention the detecting step includes measuring at least one time interval between a plurality of light interactions.

Further in accordance with a preferred embodiment of the present invention the method further includes correlating the measurement with a speed of the exercise apparatus.

Still further in accordance with a preferred embodiment of the present invention the producing step includes producing a light reflection.

Additionally in accordance with a preferred embodiment of the present invention the producing step includes producing a light strobed light.

There is also provided in accordance with a preferred embodiment of the present invention a method for measuring exercise, the method including providing a first light reflection of an exercise apparatus, detecting a second light reflection of the exercise apparatus, and determining at least one exercise measurement from a comparison of the light reflections.

Further in accordance with a preferred embodiment of the present invention the providing step includes detecting the first light reflection at a first time and the detecting a second light reflection step includes detecting the second light reflection a second time later than the first time.

Still further in accordance with a preferred embodiment of the present invention the determining step includes determining an extent of displacement of the exercise apparatus.

Additionally in accordance with a preferred embodiment of the present invention the determining step includes determining a direction of movement of the exercise apparatus.

Moreover in accordance with a preferred embodiment of the present invention the determining step includes determining a speed of the exercise apparatus.

Further in accordance with a preferred embodiment of the present invention the determining step includes determining an acceleration of the exercise apparatus.

Still further in accordance with a preferred embodiment of the present invention the determining step includes determining a deceleration of the exercise apparatus.

Additionally in accordance with a preferred embodiment of the present invention the determining step includes determining a movement-related exercise measurement and calculating an exercise force from a predetermined resistance of the exercise apparatus to force and the exercise measurement.

It is noted that throughout the specification and claims the term "light interaction" refers to reflected or strobed light resulting from an interference of a beam of light.

BRIEF DESCRIPTION OF THE DRAWINGS

The present invention will be understood and appreciated from the following detailed description, taken in conjunction with the drawings in which:

FIGS. 14A–14D, taken together, are simplified semi-pictorial semi-block diagrams showing a typical series of output signals from a single vertical line of diodes of CCD 78 of FIG. 12 for moving weights;

DETAILED DESCRIPTION OF PREFERRED EMBODIMENTS

Figure 1:
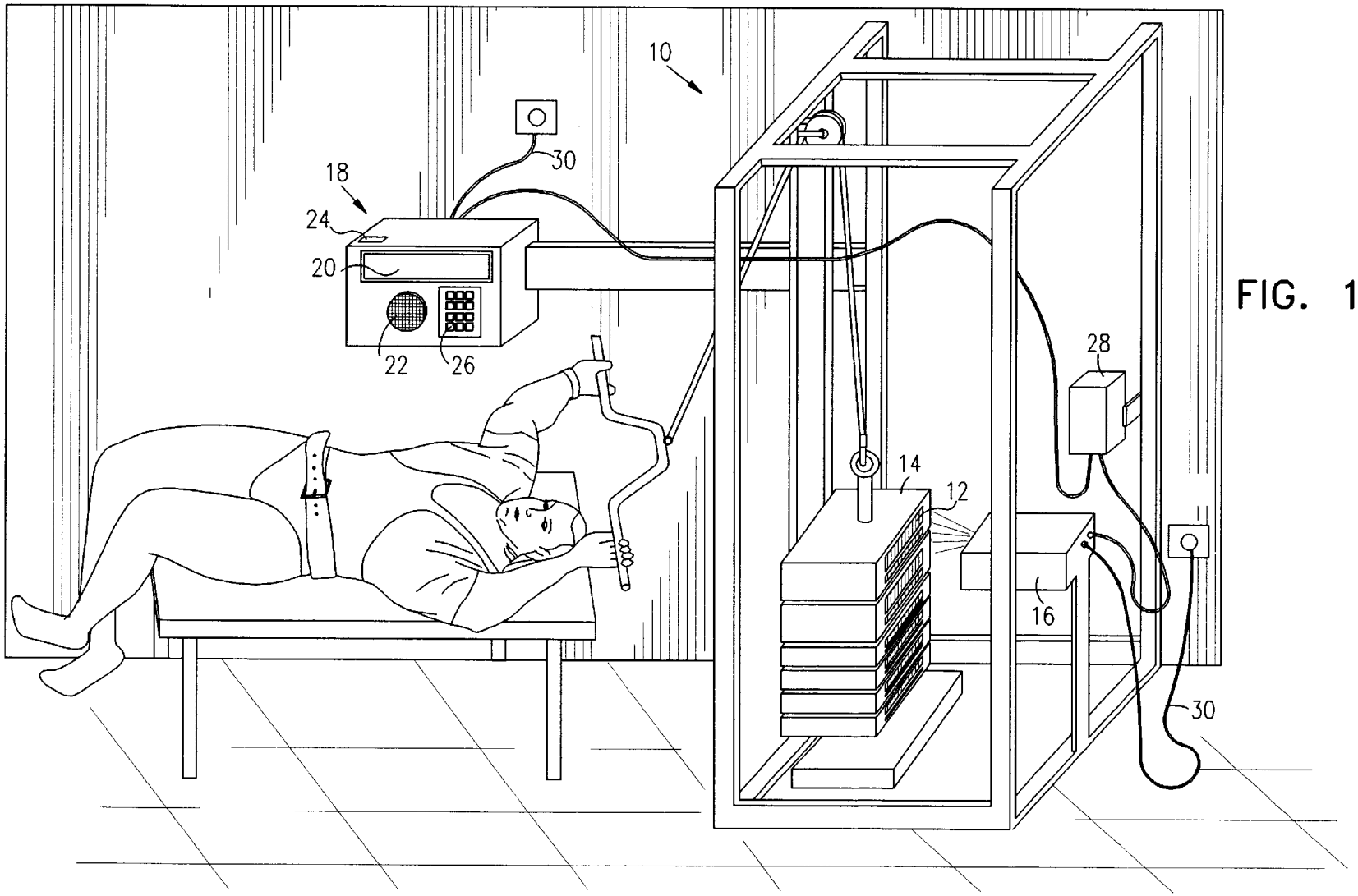
FIG. 1 is a simplified pictorial illustration of an exercise tracking system constructed and operative in accordance with a preferred embodiment of the present invention.

Reference is now made to FIG. 1 which is a simplified pictorial illustration of an exercise tracking system constructed and operative in accordance with a preferred embodiment of the present invention. The system of FIG. 1 includes exercise apparatus 10, such as a weightlifting apparatus. Exercise apparatus 10 is preferably equipped with one or more light interaction members in the form of reflectors 12, typically attached to one or more weights 14. One or more detectors 16 are preferably positioned opposite reflectors 12 such that there is an unobstructed line of sight between reflectors 12 and detector 16. Detector 16 is typically in wired or wireless communication with a computer 28 for transfer and maintenance of detection information, the nature of which will be described in greater detail hereinbelow.

A user interface 18 preferably includes a display 20, audio output apparatus 22, such as a speaker, and user identification apparatus including a card reader and/or writer 24, herein referred to as card interface 24, and a keypad 26. Card interface 24 preferably accommodates a smart card or a magnetic stripe bearing card for transferring information. User interface 18 is typically in wired or wireless communication with computer 28 for transfer and maintenance of information between display 20, audio output apparatus 22, card interface 24, and keypad 26, such as for identifying a user, displaying exercise information, maintaining a card bearer's exercise history and exercise parameters, and audibly instructing a user and warning a user when exercise parameters are exceeded. Computer 28 may be housed within user interface 18 or detector 16. Detector 16 is typically powered via an AC connection 30, although an internal battery may be used (not shown). User interface 18 may be similarly powered.

Figure 2:
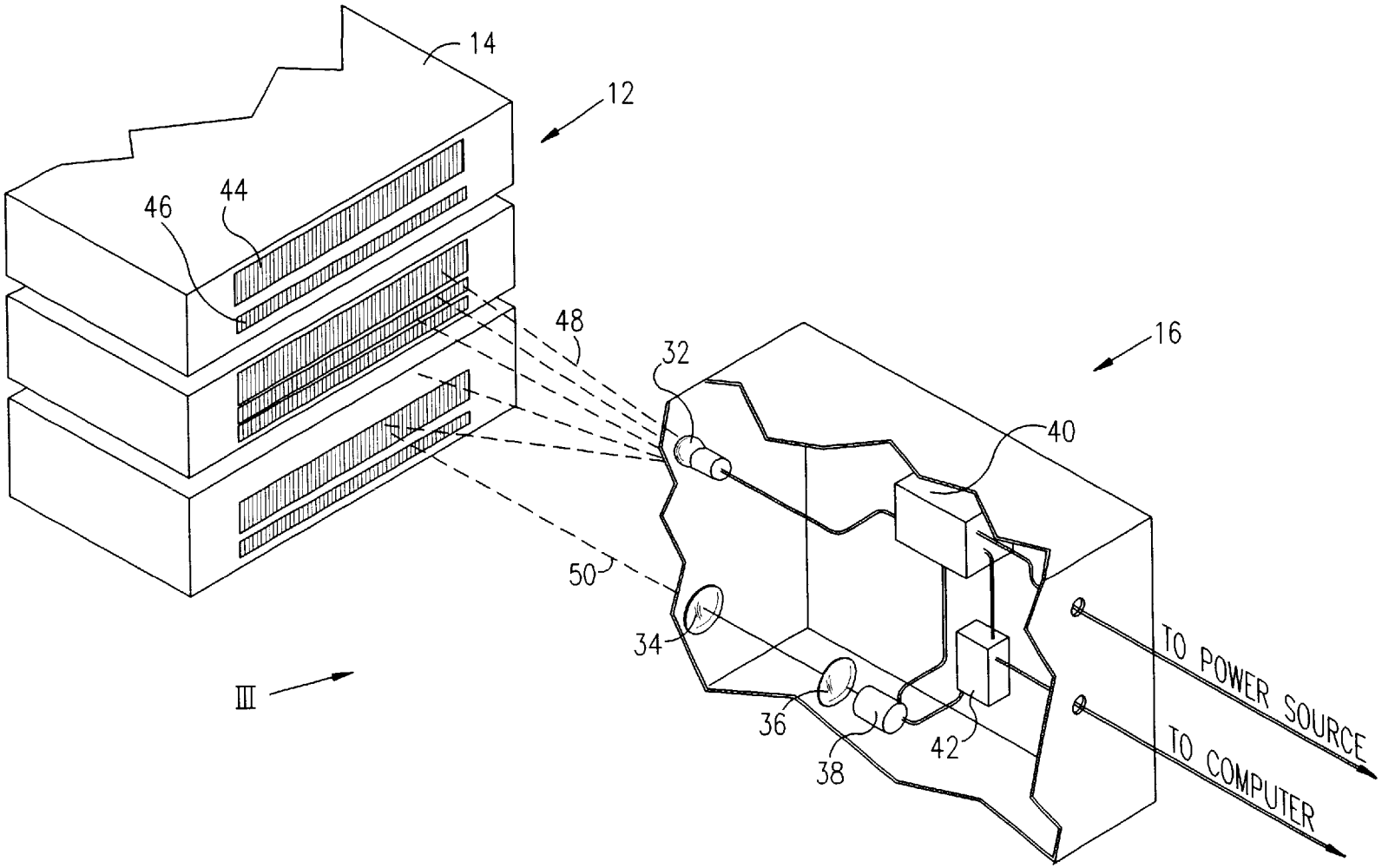
FIG. 2 is a simplified pictorial illustration of components of the exercise tracking system of FIG. 1 in a single-detector implementation constructed and operative in accordance with a preferred embodiment of the present invention.

Reference is now made to FIG. 2 which is a simplified pictorial illustration of components of the exercise tracking system of FIG. 1 in a single-detector implementation constructed and operative in accordance with a preferred embodiment of the present invention. Detector 16 typically includes a light source 32, such as the L1915-01 Infrared Emitting Diode commercially available from Hamamatsu Photonics K.K., Solid State Division, 1126-1 Ichino-cho, Hamamatsu City 435-91, Japan, for producing a light emission 48, a lens 34, such as the KBX064 Bi-convex Optical Glass Lens commercially available from Newport Inc., 1791 Deere Avenue, Irvine, Calif. 92606 U.S.A., for receiving a light reflection 50, a filter 36, such as the #5036 RG-715 RSharp Cut-off Glass Filter commercially available from Reynard Corporation, 1020 Calle Sombra, San Clemente, Calif. 92673-6227 U.S.A., and a light detector 38, such as the S5821 Si PIN Photodiode also available from Hamamatsu.

It is appreciated that a commercially-available light source of any wavelength may be used provided that a commercially-available light detector capable of detecting light of the same wavelength is used.

Detector 16 also typically includes a power supply 40, connectable to an external power supply or powered by an internal battery. Detector 16 also typically includes a processor 42 in communication with light detector 38. Processor 42 is also typically in wired or wireless communication with computer 28. Light source 32 may alternatively be separate from detector 16. Reflectors 12 may be fixedly attached, removably attached, or otherwise assembled with each weights 14. In the present embodiment each weight 14 preferably includes two or more reflectors of varying widths, such as wide reflector 44 and narrow reflector 46.

Different combinations of reflectors of varying widths may be arranged in various sequences to identify a weight type or a specific weight platter much like dots and dashes are used to identify characters in Morse code, such as will be described in greater detail hereinbelow.

Figure 3A:
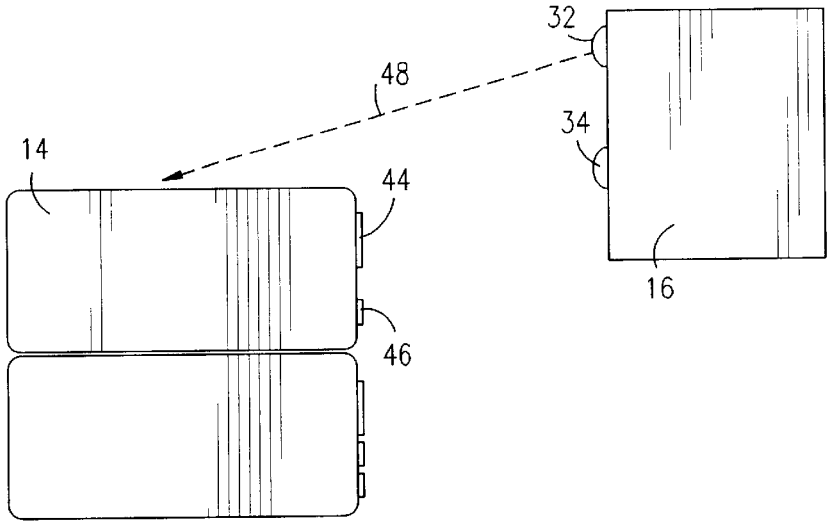
FIGS. 3A–3D, taken together, are side-view semi-pictorial semi-block diagram illustrations of the single-detector implementation of FIG. 2 taken along arrow III.
Figure 3B:
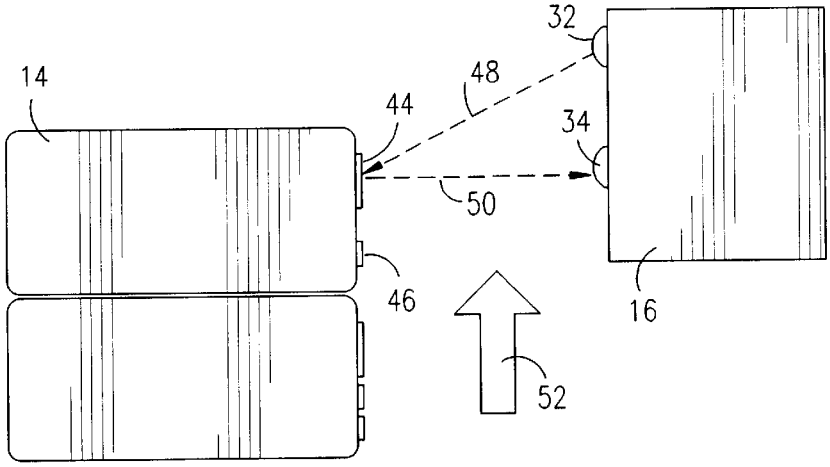
Figure 3C:
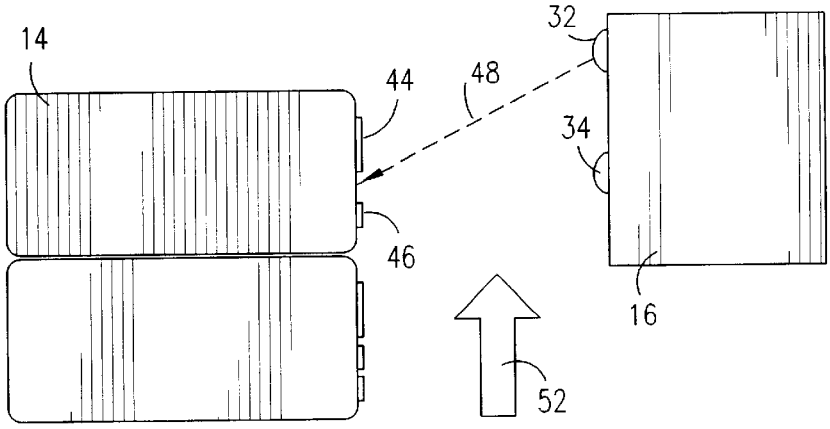
Figure 3D:
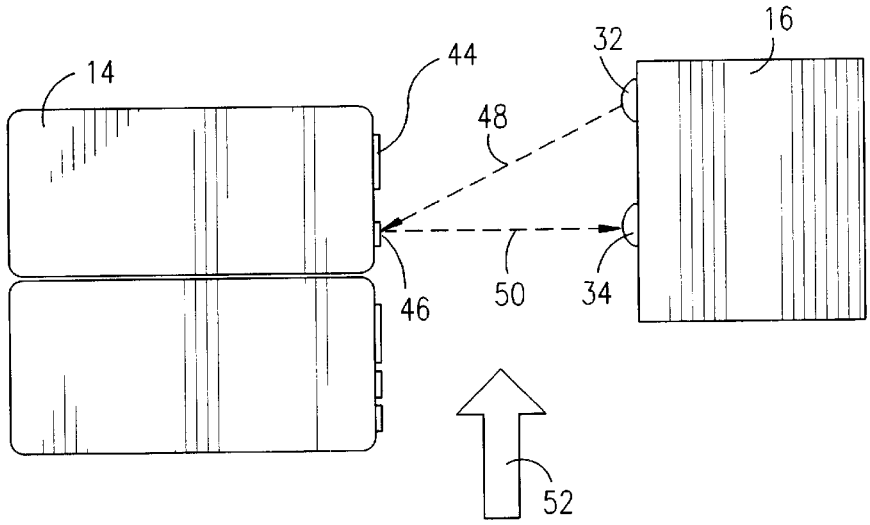

Additional reference is now made to FIGS. 3A–3D which, taken together, are side-view semi-pictorial semi-block diagram illustrations of the single-detector implementation of FIG. 2 taken along arrow III. FIG. 3A shows detector 16 and weights 14 prior to the start of a weightlifting sequence. Light source 32 is shown producing a light emission 48 in the direction of weights 14. No reflection is received at lens 34, either as no light hits reflectors 44 or 46 or as no reflection arrives within the field of view of lens 34. FIG. 3B shows the weightlifting sequence underway as weights 14 are moved in the direction of an arrow 52. Light emission 48 is shown impinging on wide reflector 44, resulting in light reflection 50 arriving within the field of view of lens 34. The weightlifting sequence continues in FIG. 3C with wide reflector 44 having moved past the field of view of lens 34, again with no reflection being received by lens 34. FIG. 3D shows narrow reflector 46 receiving light emission 48 and reflecting light reflection 50 within the field of view of lens 34.

Figure 4A:
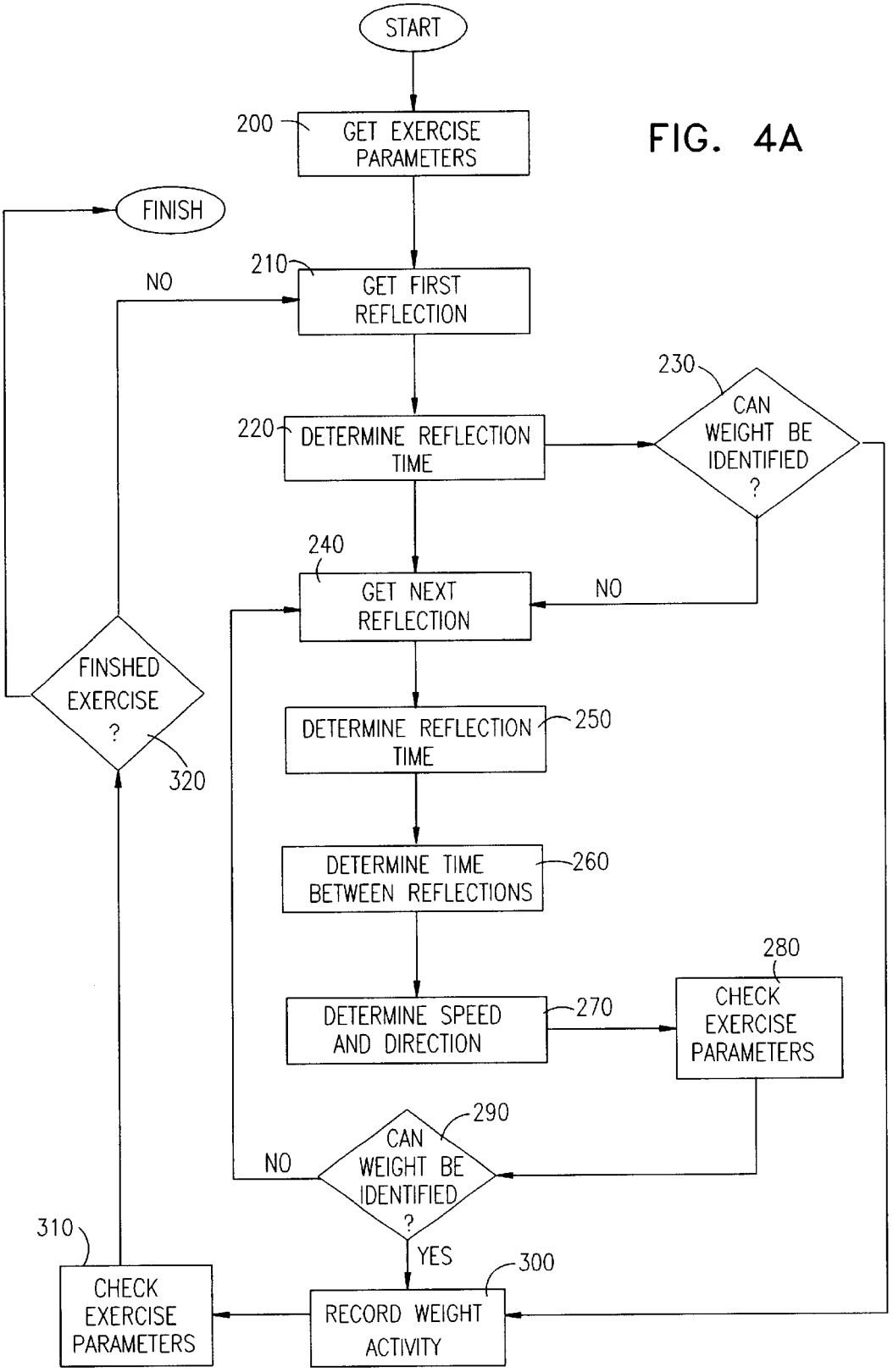
FIG. 4A is a simplified flowchart illustration of a method of operation of the single-detector implementation of FIGS. 2 and 3A–3D in accordance with a preferred embodiment of the present invention.

Additional reference is now made to FIG. 4A which is a simplified flowchart illustration of a method of operation of the single-detector implementation of FIGS. 2 and 3A–3D in accordance with a preferred embodiment of the present invention. In the method of FIG. 4A a subject preferably enters his/her identity and exercise parameters (step 200), typically including the subject's weightlifting program and history and other instructions, via card interface 24 and/or keypad 26 (FIG. 1). As a weightlifting cycle begins a first reflection is detected at detector 16 (step 210). While a variety of methods may be used to detect a reflection, a preferred method is described in greater detail hereinbelow with reference to FIG. 4B.

Once a reflection has been received the duration of the reflection is determined (step 220). The duration of the reflection may be used to determine which reflector passed within the field of view of lens 34. If the identity of the reflector is not sufficient to identify the weight being lifted (step 230) then the next reflection is retrieved (step 240), otherwise processing continues with step 300. Once the next reflection is received (step 240) the duration of the next reflection is determined (step 250). The time between reflections is then determined (step 260) and may be used to determine both the speed with which the identified weight is being lifted where a known distance between reflectors is traversed in a given time, as well as the direction of the lift such as where a wide reflector is arranged to precede a narrow reflector for a given lift direction, and vice versa (step 270). The speed and direction may be compared with the subject's exercise parameters (step 280), and alarms or other outputs may be provided via display 20 and audio output apparatus 22 to indicate the subject's progress and whether the subject's exercise parameters are being met. If the identified reflector sequence is sufficient to identify the weight being lifted (step 290) then the weight information may be recorded (step 300) and the subject's exercise parameters may again be checked against this information (step 310). If the weightlifting session is not complete (step 320) operation continues with the next weight (step 210).

Figure 4B:
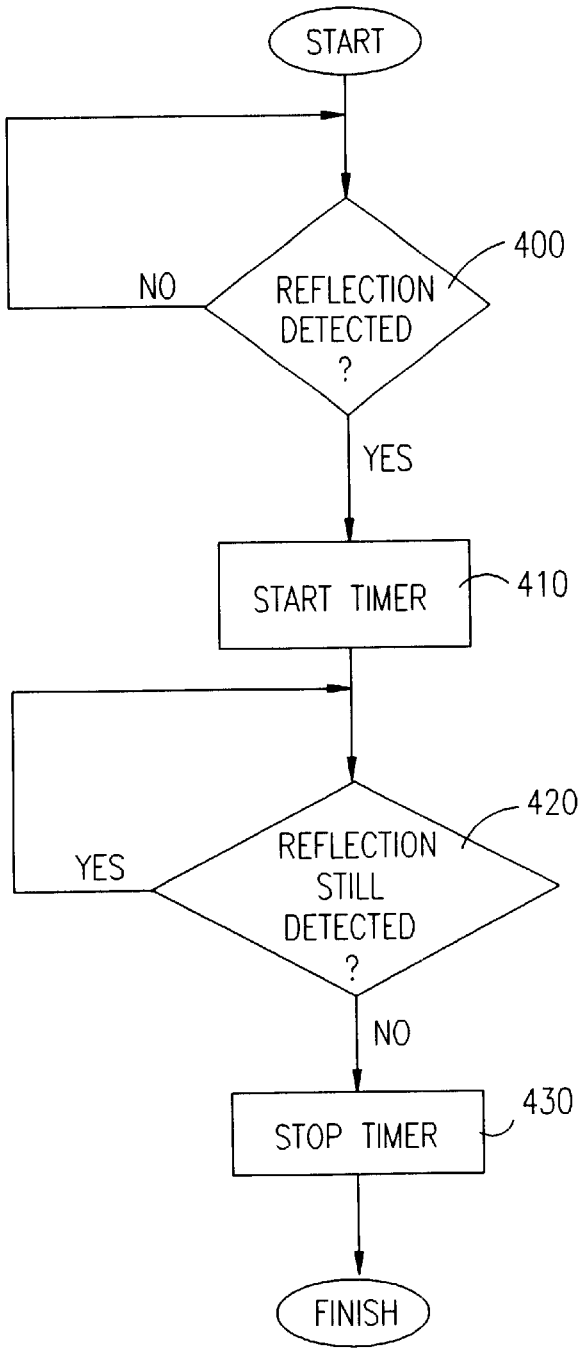
FIG. 4B is a simplified flowchart illustration of a preferred method of implementing steps 210 and 240 of FIG. 4A in accordance with a preferred embodiment of the present invention.

Reference is now made to FIG. 4B which is a simplified flowchart illustration of a preferred method of implementing steps 210 and 240 of FIG. 4A. In the method of FIG. 4B a reflection is detected (step 400) and the time at which the reflection is first detected is noted (step 410). The duration of the reflection is timed as long as the reflection is detected (step 420). Timing ceases once the reflection is no longer detected (step 430).

Figure 5A:
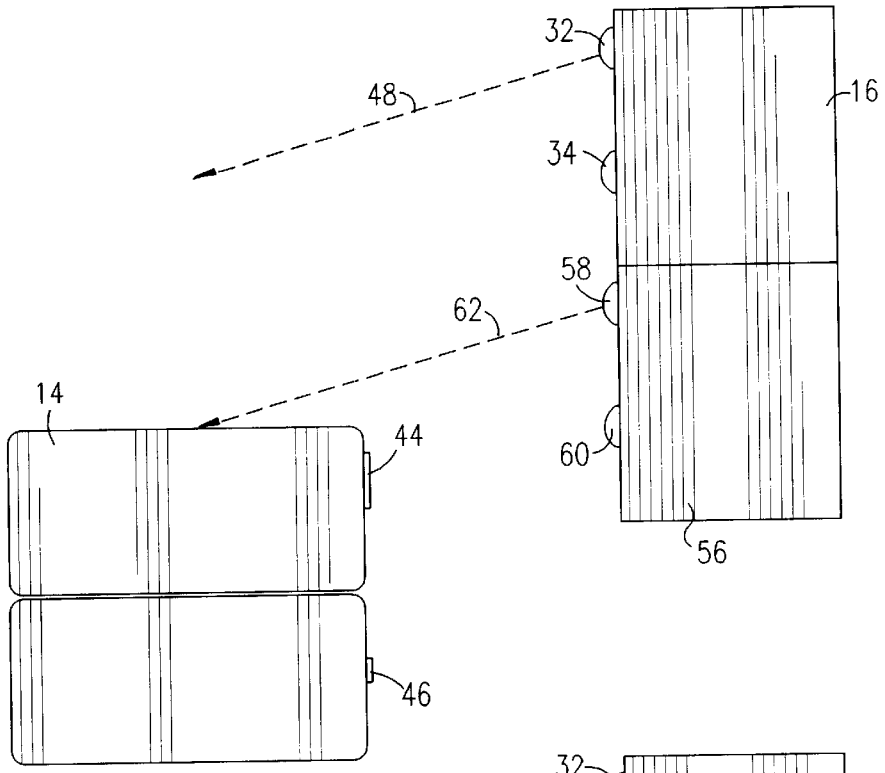
FIGS. 5A–5E, taken together, are side-view semi-pictorial semi-block diagram illustrations of a multiple-detector implementation of the exercise tracking system of FIG. 1 constructed and operative in accordance with another preferred embodiment of the present invention.

Reference is now made to FIGS. 5A–5E which, taken together, are side-view semi-pictorial semi-block diagram illustrations of a multiple-detector implementation of the exercise tracking system of FIG. 1 constructed and operative in accordance with another preferred embodiment of the present invention. FIG. 5A shows detector 16, a second detector 56, and weights 14 prior to the start of a weight-lifting sequence. In the present embodiment each weight 14 preferably includes a single reflector, such as wide reflector 44 and narrow reflector 46. Light source 32 and a light source 58 are shown producing light emission 48 and a light emission 62 in the direction of weights 14, although it is appreciated that a single light source may be used to provide reflections for both lens 34 and a lens 60. No reflections are received at lenses 34 and 60, either as no light hits reflectors 44 or 46 or as no reflections arrive within the fields of view of lenses 34 and 60.

Figure 5B:
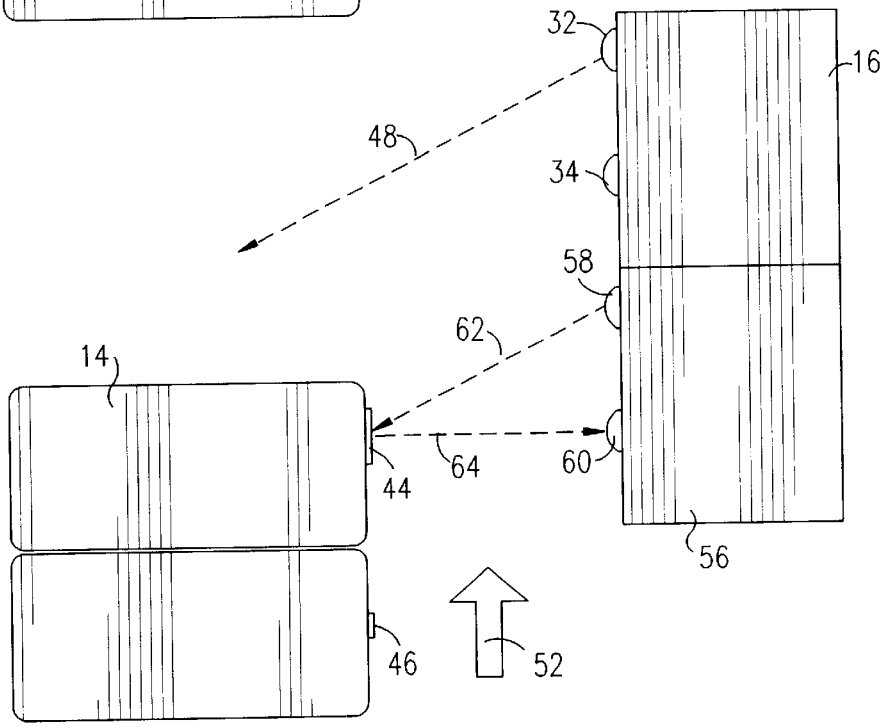
Figure 5C:
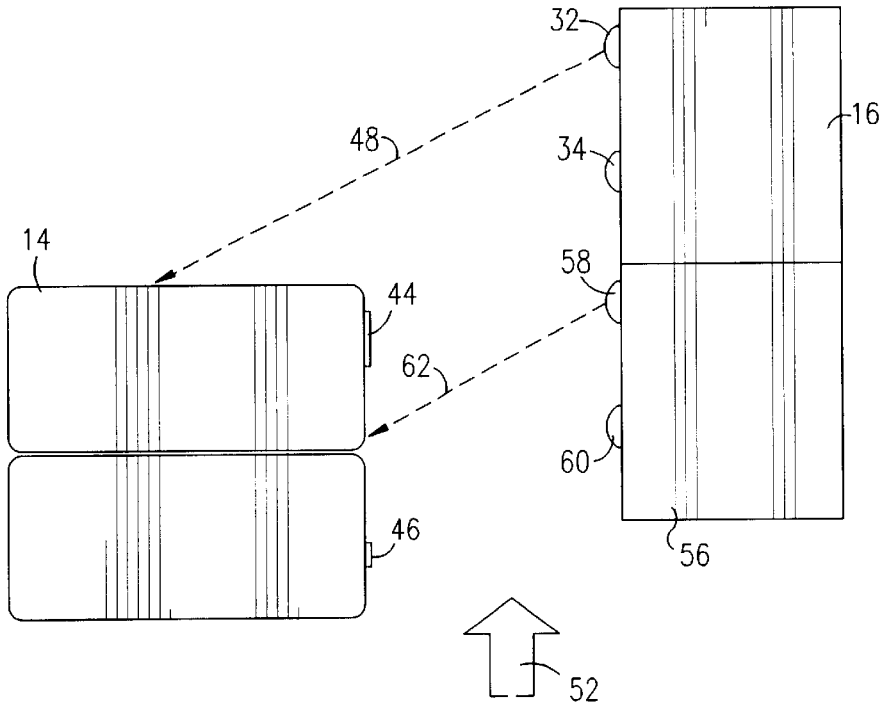
Figure 5D:
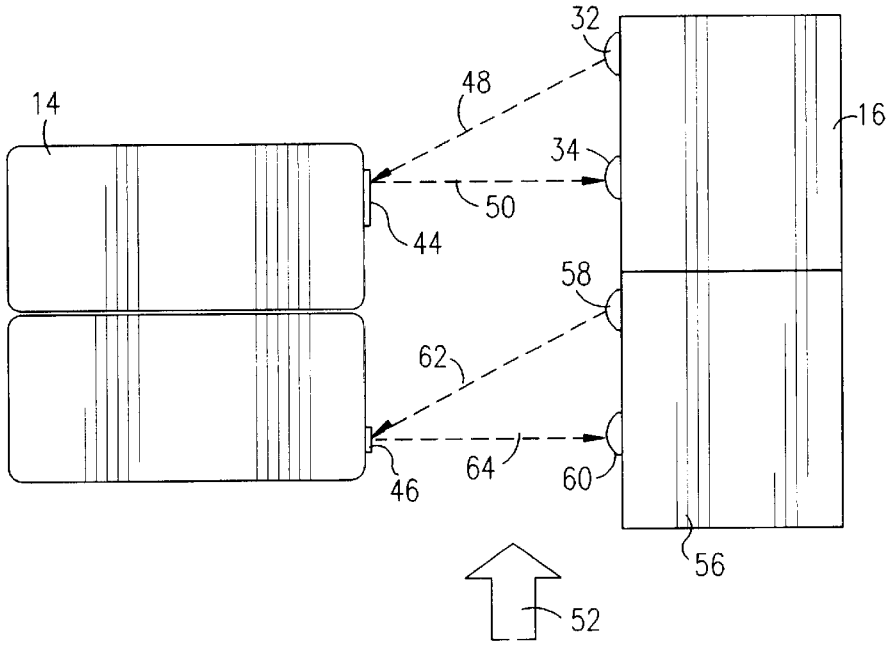
Figure 5E:
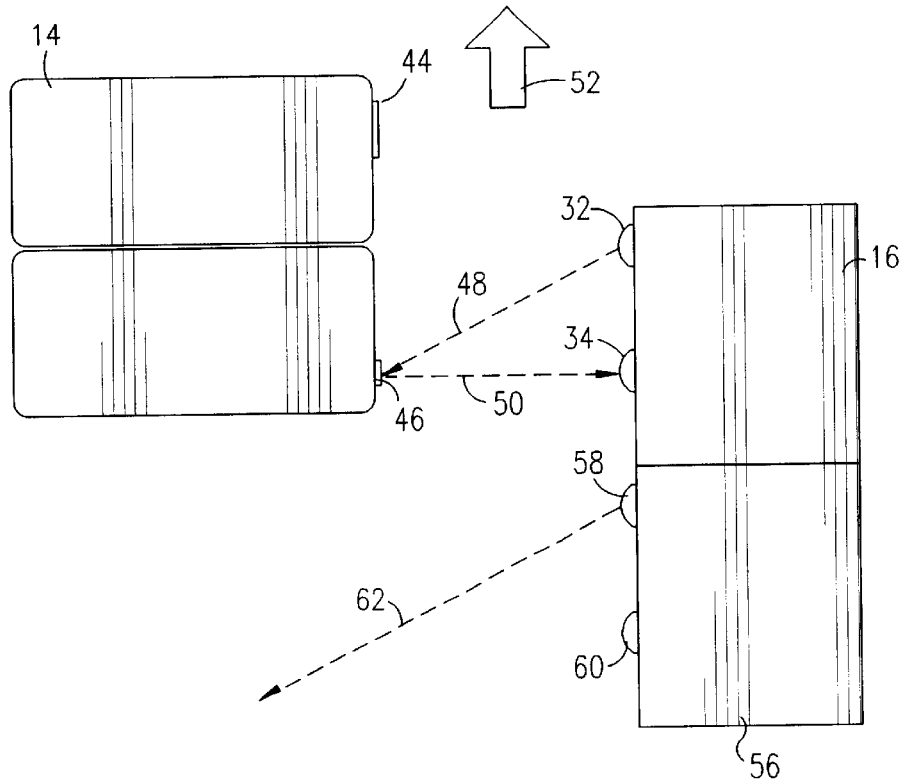

FIG. 5B shows the weightlifting sequence underway as weights 14 are moved in the direction of arrow 52. Light emission 62 is shown impinging on wide reflector 44, resulting in a light reflection 64 arriving within the field of view of lens 60. The weightlifting sequence continues in FIG. 5C with wide reflector 44 having moved past the field of view of lens 60, again with no reflection being received by lens 34. FIG. 5D shows light emission 48 is shown impinging on wide reflector 44, resulting in light reflection 50 arriving within the field of view of lens 34. Light emission 62 is also shown impinging on narrow reflector 46, resulting in light reflection 64 arriving within the field of view of lens 60, although it is appreciated that the detections of light emissions 50 and 64 need not occur simultaneously. Finally, FIG. 5E shows wide reflector 44 having moved past the field of view of lens 34, again with no reflection being received by lens 34. Light emission 48 is shown impinging on narrow reflector 46, resulting in light reflection 50 arriving within the field of view of lens 34.

Figure 6:
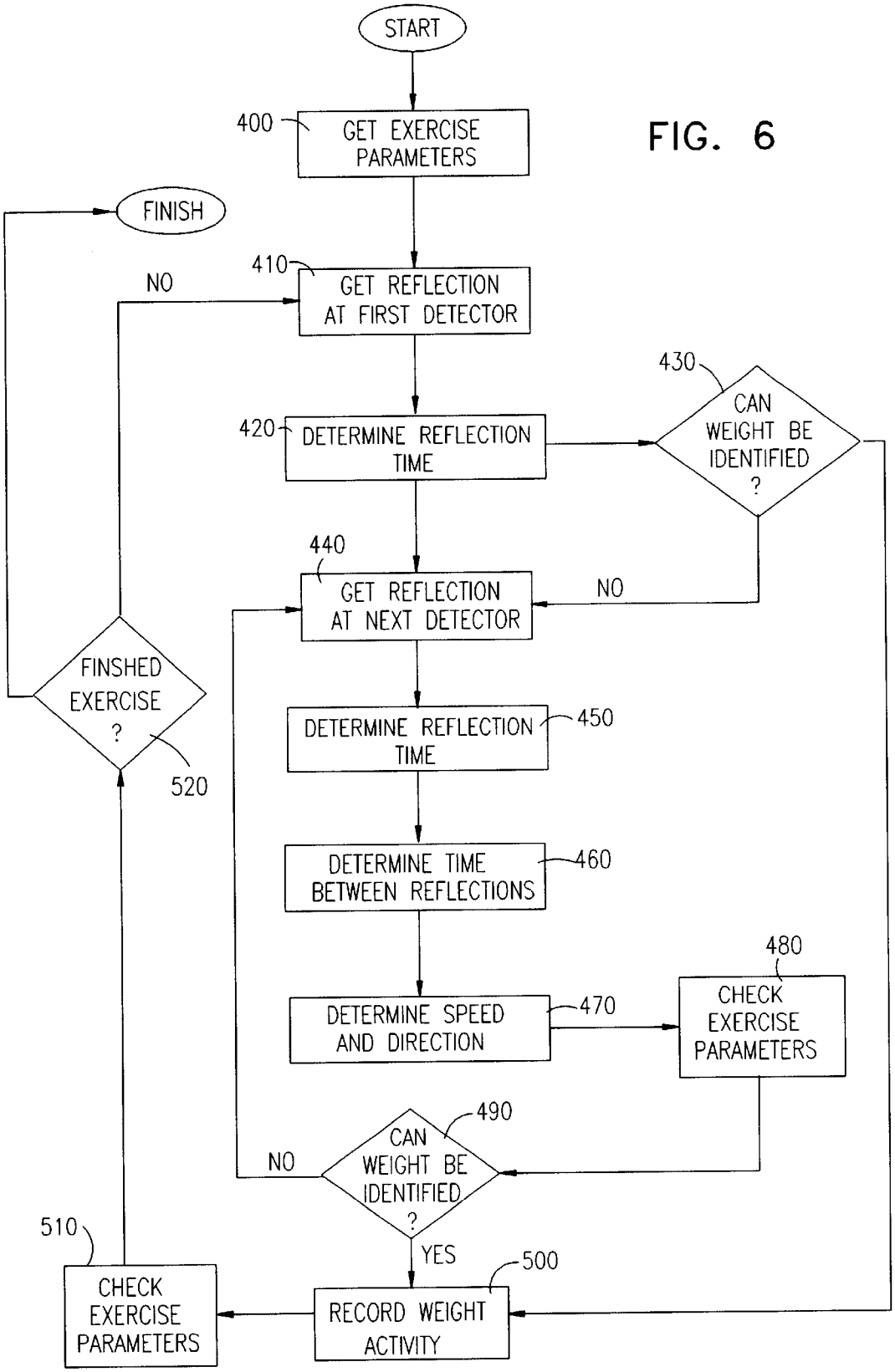
FIG. 6 is a simplified flowchart illustration of a method of operation of the multiple-detector implementation of FIGS. 5A–5E in accordance with a preferred embodiment of the present invention.

Additional reference is now made to FIG. 6 which is a simplified flowchart illustration of a method of operation of the multiple-detector implementation of FIGS. 5A–5E in accordance with a preferred embodiment of the present invention. In the method of FIG. 6 a subject preferably enters his/her identity and exercise parameters (step 400), typically including the subject's weightlifting program and history, via card interface 24 and/or keypad 26 (FIG. 1). As a weightlifting cycle begins a reflection is first detected at detector 56 (step 410), such as in the manner described hereinabove with reference to FIG. 4B. Once a reflection has been received the duration of the reflection is determined (step 420). The duration of the reflection may be used to determine which reflector passed within the field of view of lens 60. If the identity of the reflector is not sufficient to identify the weight being lifted (step 430) then the reflection retrieved at detector 16 (step 440), otherwise processing continues with step 500.

Once the reflection is received at detector 16 (step 440) the duration of the next reflection is determined (step 450). The time between detections is then determined (step 460) and may be used to determine both the speed with which the identified weight is being lifted where a known distance between reflectors is traversed in a given time, as well as the direction based on which detector first registered a reflection (step 470). The speed and direction may be compared with the subject's exercise parameters (step 480), and alarms or other outputs may be provided via display 20 and audio output apparatus 22 to indicate the subject's progress and whether the subject's exercise parameters are being met. If the identified reflector sequence is sufficient to identify the weight being lifted (step 490) then the weight information may be recorded (step 500) and the subject's exercise parameters may again be checked against this information (step 510). If the weightlifting session is not complete (step 520) operation continues with the next weight (step 410).

Figure 7A:
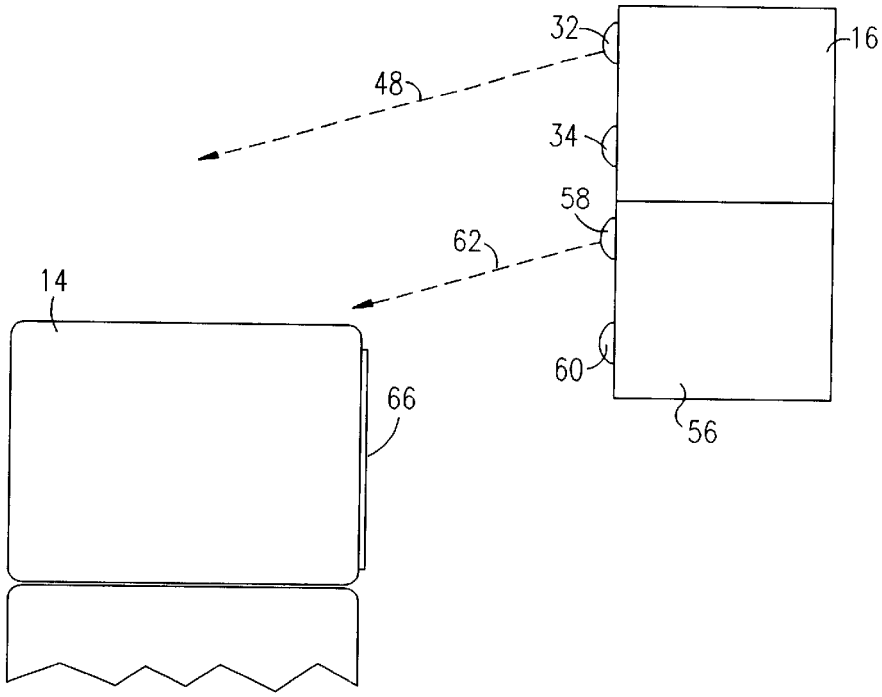
FIGS. 7A–7E, taken together, are side-view semi-pictorial semi-block diagram illustrations of a multiple-detector implementation of the exercise tracking system of FIG. 1 constructed and operative in accordance with another preferred embodiment of the present invention.

Reference is now made to FIGS. 7A–7E which, taken together, are side-view semi-pictorial semi-block diagram illustrations of a multiple-detector implementation of the exercise tracking system of FIG. 1 constructed and operative in accordance with another preferred embodiment of the present invention. FIG. 7A shows detector 16, second detector 56, and weights 14 prior to the start of a weightlifting sequence. In the present embodiment each weight 14 preferably includes a single reflector, such as wide reflector 66. Light source 32 and a light source 58 are shown producing light emission 48 and a light emission 62 in the direction of weights 14, although it is appreciated that a single light source may be used to provide reflections for both lenses 34 and 60. No reflections are yet received at lenses 34 and 60, either as no light hits wide reflector 66 or as no reflections arrive within the fields of view of lenses 34 and 60.

Figure 7B:
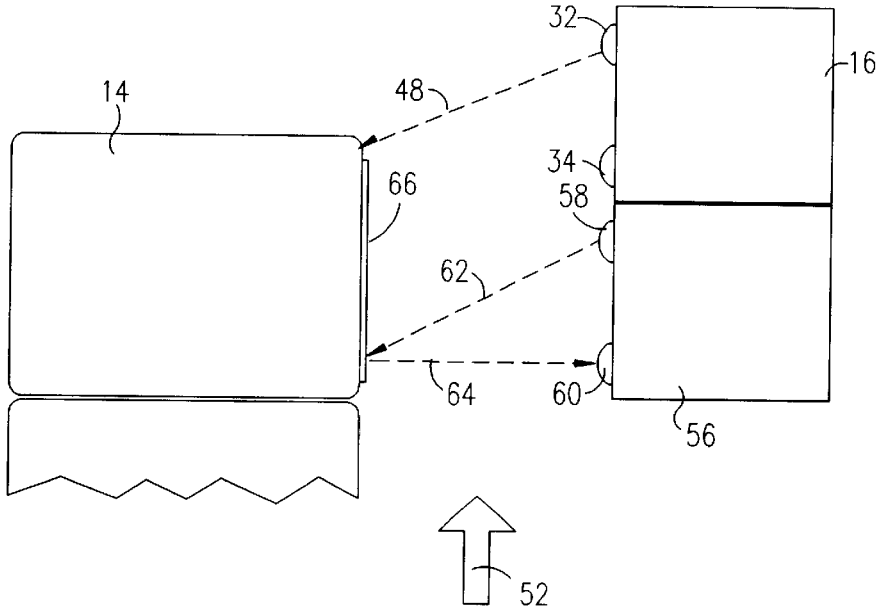
Figure 7C:
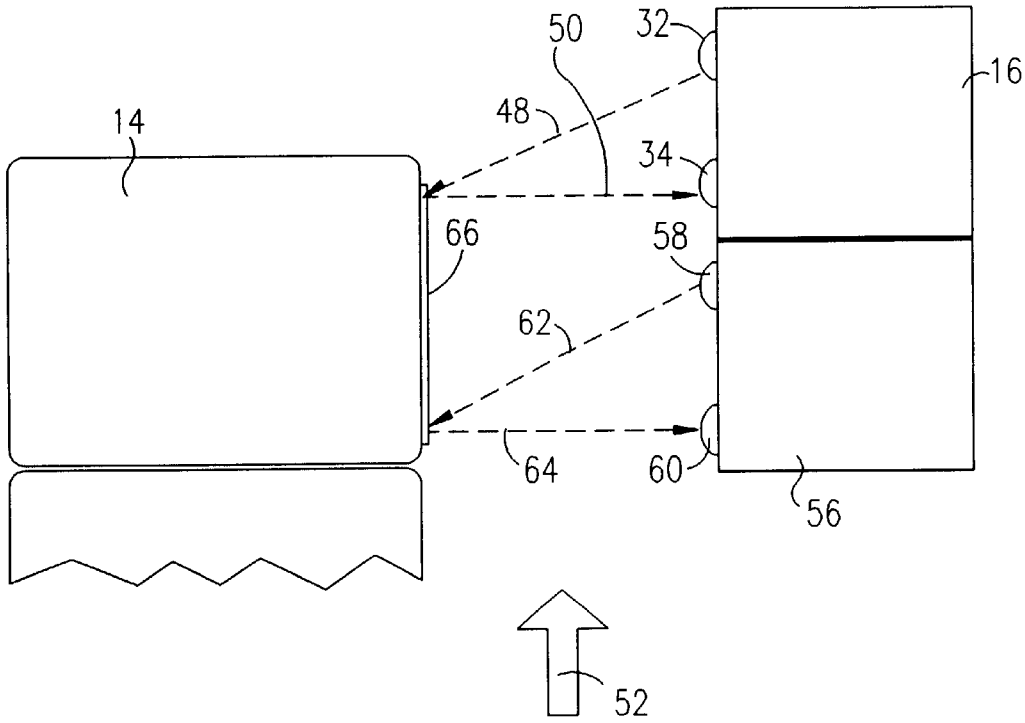
Figure 7D:
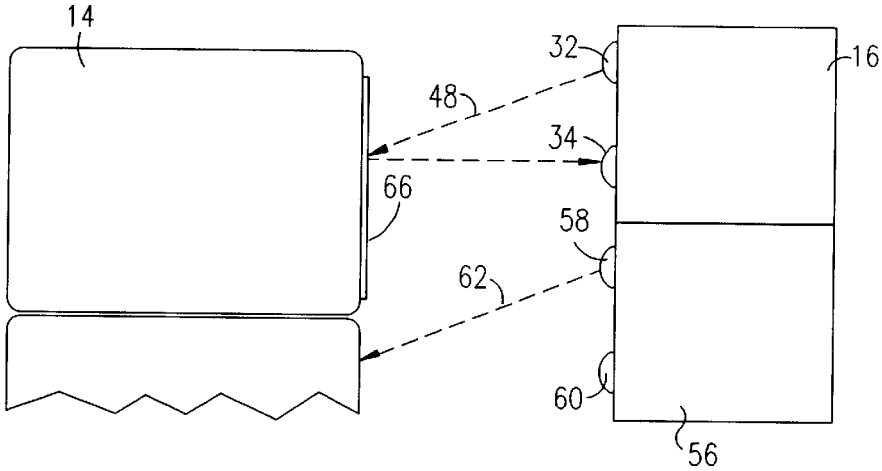
Figure 7E:
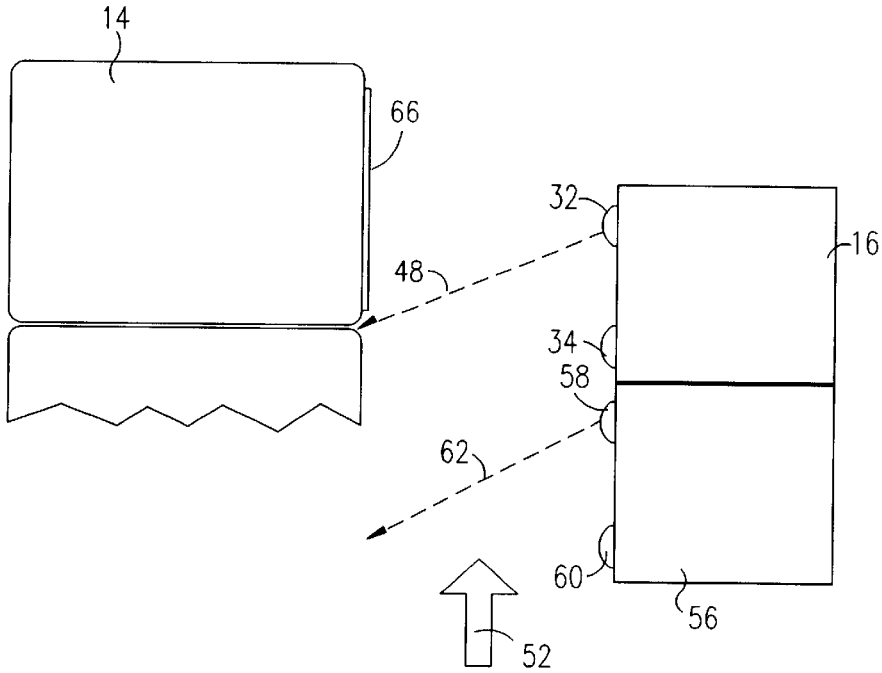

FIG. 7B shows the weightlifting sequence underway as weights 14 are moved in the direction of arrow 52. Light emission 62 is shown impinging on wide reflector 66, resulting in a light reflection 64 arriving within the field of view of lens 60. The weightlifting sequence continues in FIG. 7C with light reflection 64 still arriving at lens 60 while light emission 48 simultaneously impinges on wide reflector 66, resulting in light reflection 50 arriving within the field of view of lens 34. FIG. 7D shows light emission 48 still impinging on wide reflector 66, resulting in light reflection 50 continuing to arrive at lens 34, while light emission 62 no longer impinges on wide reflector 66, thus resulting in no light reflection within the field of view of lens 60. Finally, FIG. 7E shows wide reflector 66 having moved past the fields of view of both lenses 34 and 60.

Figure 8:
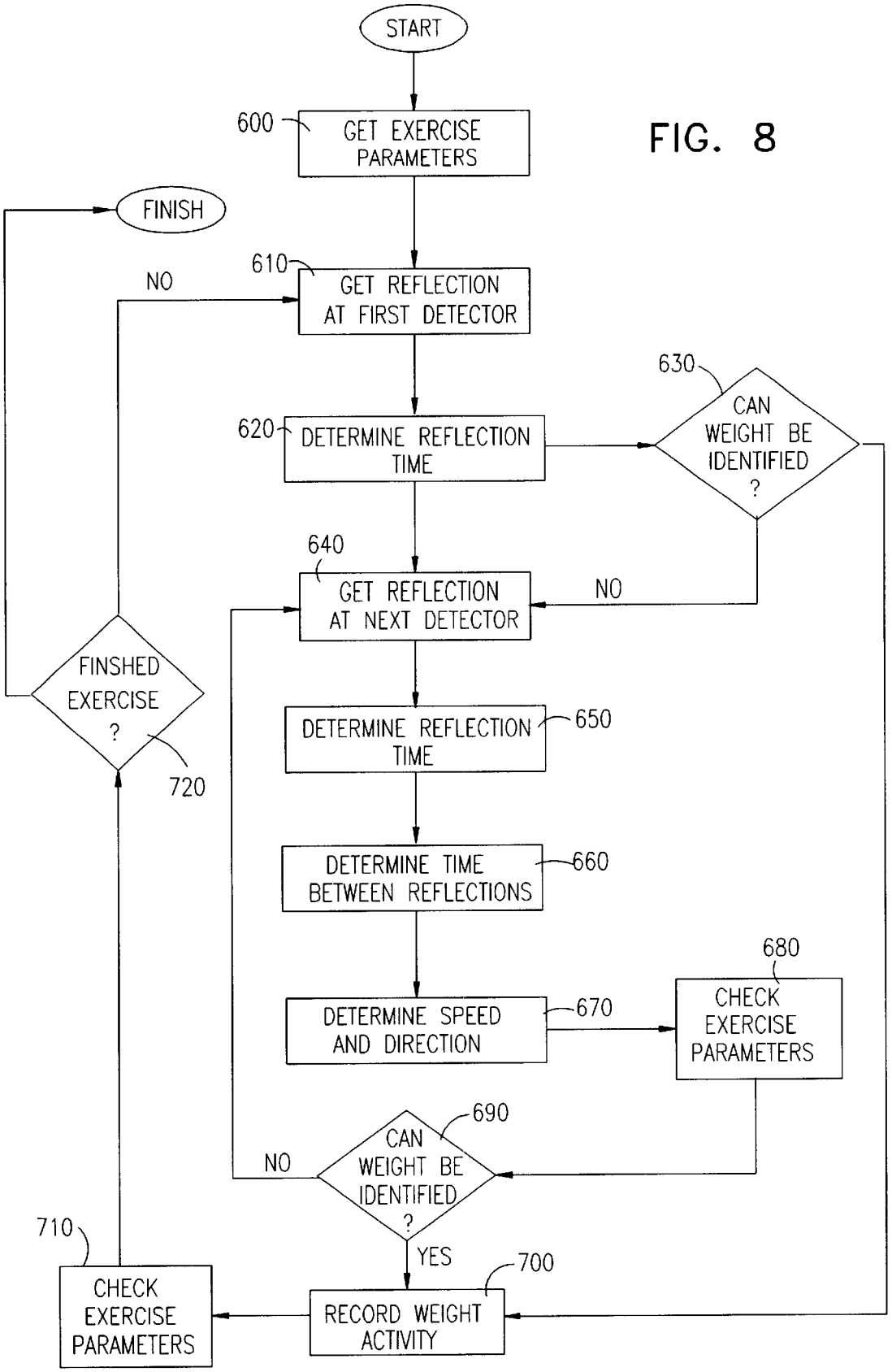
FIG. 8 is a simplified flowchart illustration of a method of operation of the multiple-detector implementation of FIGS. 7A–7E in accordance with a preferred embodiment of the present invention.

Additional reference is now made to FIG. 8 which is a simplified flowchart illustration of a method of operation of the multiple-detector implementation of FIGS. 7A–7E in accordance with a preferred embodiment of the present invention. In the method of FIG. 8 a subject preferably enters his/her identity and exercise parameters (step 600), typically including the subject's weightlifting program and history, via card interface 24 and/or keypad 26 (FIG. 1). As a weightlifting cycle begins a reflection is first detected at detector 56 (step 610), such as in the manner described hereinabove with reference to FIG. 4B. Once a reflection has been received the duration of the reflection is determined (step 620). The duration of the reflection may be used to determine which reflector passed within the field of view of lens 60. If the identity of the reflector is not sufficient to identify the weight being lifted (step 630) then the reflection is retrieved at detector 16 (step 640), otherwise processing continues with step 700.

Once the reflection is received at detector 16 (step 640) the duration of the next reflection is determined (step 650). The time between detections is then determined (step 660) and may be used to determine both the speed with which the identified weight is being lifted given the time between detected reflections, as well as the direction based on which detector first registered a reflection (step 670). The speed and direction may be compared with the subject's exercise parameters (step 680), and alarms or other outputs may be provided via display 20 and audio output apparatus 22 to indicate the subject's progress and whether the subject's exercise parameters are being met. If the identified reflector or reflector sequence is sufficient to identify the weight being lifted (step 690) then the weight information may be recorded (step 700) and the subject's exercise parameters may again be checked against this information (step 710). If the weightlifting session is not complete (step 720) operation continues with the next weight (step 610).

Figure 9:
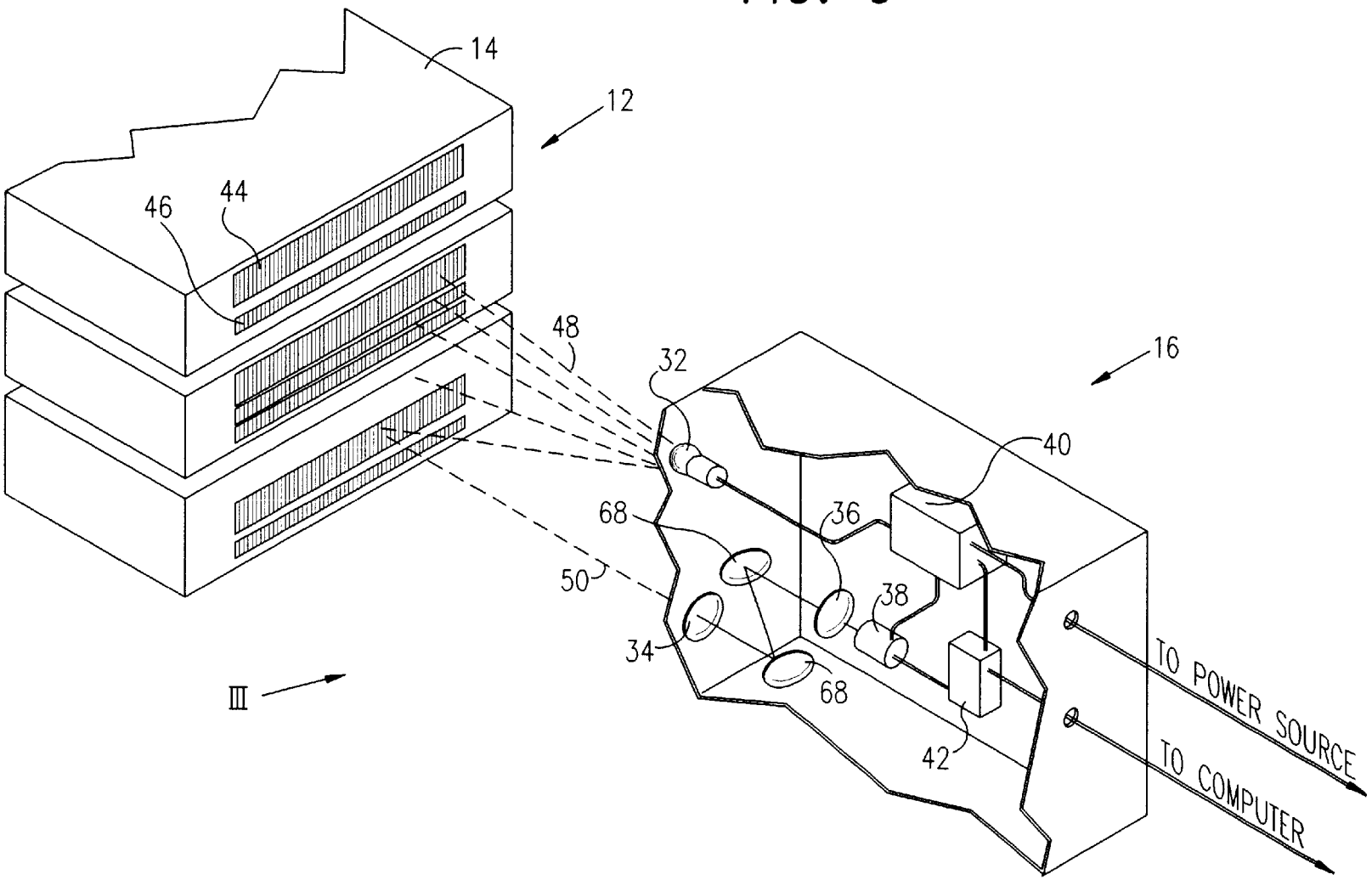
FIG. 9 is a simplified pictorial illustration of components of the exercise tracking system of FIG. 1 in a single-detector implementation constructed and operative in accordance with another preferred embodiment of the present invention.

Reference is now made to FIG. 9 which is a simplified pictorial illustration of components of the exercise tracking system of FIG. 1 in a single-detector implementation constructed and operative in accordance with another preferred embodiment of the present invention. The embodiment of FIG. 9 is generally similar to the embodiment of FIG. 2 with the exception that one or more mirrors 68 are shown reflecting light reflection 50 between lens 34 and light detector 38. Mirrors 68, such as the A43,874, commercially available from Edmund Scientific Company, 101 E. Gloucester Pike, Barrington, N.J. USA 08007-1380, may be used to shorten the distance between lens 34 and light detector 38.

Figure 10:
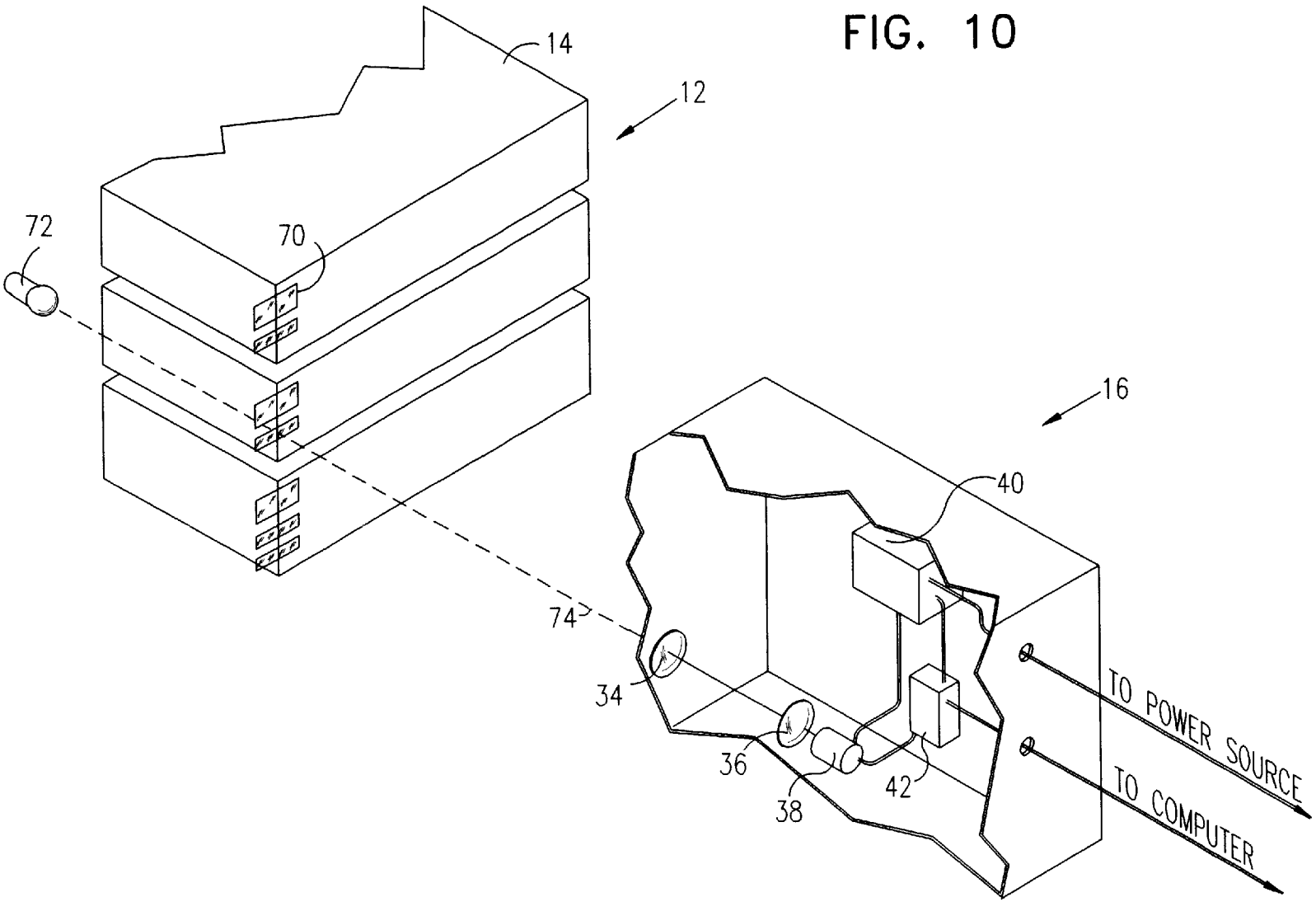
FIG. 10 is a simplified pictorial illustration of components of the exercise tracking system of FIG. 1 in a single-detector implementation constructed and operative in accordance with another preferred embodiment of the present invention.

Reference is now made to FIG. 10 which is a simplified pictorial illustration of components of the exercise tracking system of FIG. 1 in a single-detector implementation constructed and operative in accordance with a preferred embodiment of the present invention. The embodiment of FIG. 10 is generally similar to the embodiment of FIG. 2 with the exception that detector 16 does not include light source 32. Rather, a light source 72 is preferably positioned beyond one or more light interaction members in the form of tabs 70 which are attached to weights 14. Tabs 70 are preferably spaced from one another sufficient to allow a light beam 74 to pass between tabs 70. Tabs 70 are preferably of sufficient opacity such as to prevent light beam 74 from being detected at detector 16 when light beam 74 impinges on tab 70. Tabs 70 may be fixedly attached, removably attached, or otherwise assembled with each weights 14. In the present embodiment weights 14 preferably include an arrangement of tabs of varying widths for purposes of determining speed, direction, and weight identity, such as is described hereinabove with reference to wide reflector 44 and narrow reflector 46 (FIGS. 2–5E).

Figure 11:
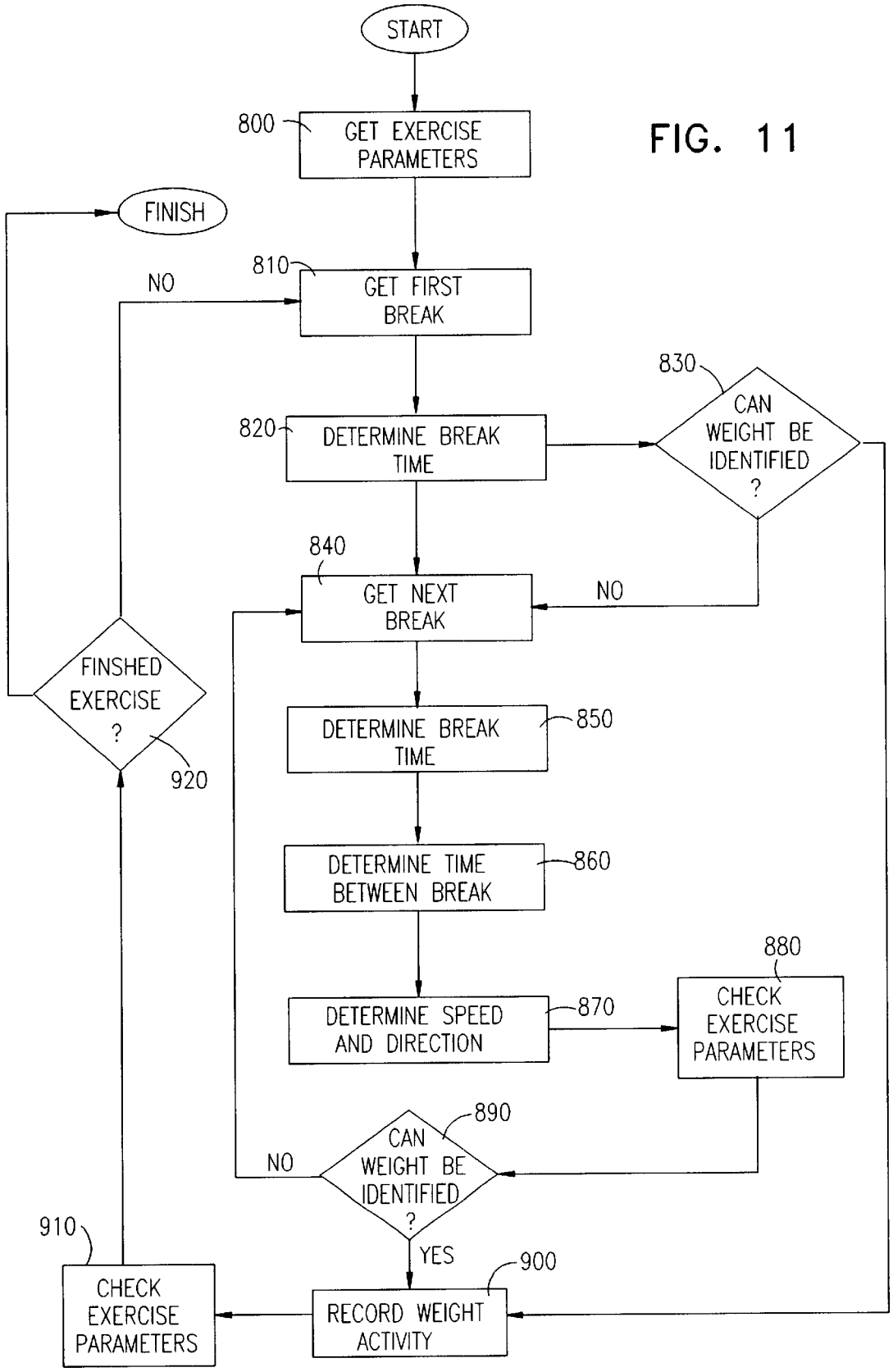
FIG. 11 is a simplified flowchart illustration of a method of operation of the single-detector implementation of FIG. 10 in accordance with a preferred embodiment of the present invention.

Additional reference is now made to FIG. 11 which is a simplified flowchart illustration of a method of operation of the single-detector implementation of FIG. 10 in accordance with a preferred embodiment of the present invention. In the method of FIG. 11 a subject preferably enters his/her identity and exercise parameters (step 800), typically including the subject's weightlifting program and history and other instructions, via card interface 24 and/or keypad 26 (FIG. 1). Preferably, a light beam is continuously projected towards detector 16.

As a weightlifting cycle begins a first break in the light beam is detected at detector 16 (step 810). Once a light beam has been broken the duration of the break in the light beam is determined (step 820). The duration of break in the light beam may be used to determine which tab obscured the field of view of lens 34. If the identity of the tab is not sufficient to identify the weight being lifted (step 830) then the next light beam break is retrieved (step 840), otherwise processing continues with step 900. Once the next break in the light beam is detected (step 840) the duration of the next light beam break is determined (step 850). The time between in the light beam is then determined (step 860) and may be used to determine both the speed with which the identified weight is being lifted where a known distance between tabs is traversed in a given time, as well as the direction of the lift such as where a wide tab is arranged to precede a narrow tab for a given lift direction, and vice versa (step 870). The speed and direction may be compared with the subject's exercise parameters (step 880), and alarms or other outputs may be provided via display 20 and audio output apparatus 22 to indicate the subject's progress and whether the subject's exercise parameters are being met. If the identified tab sequence is sufficient to identify the weight being lifted (step 890) then the weight information may be recorded (step 900) and the subject's exercise parameters may again be checked against this information (step 910). If the weightlifting session is not complete (step 920) operation continues with the next weight (step 810).

Figure 12:
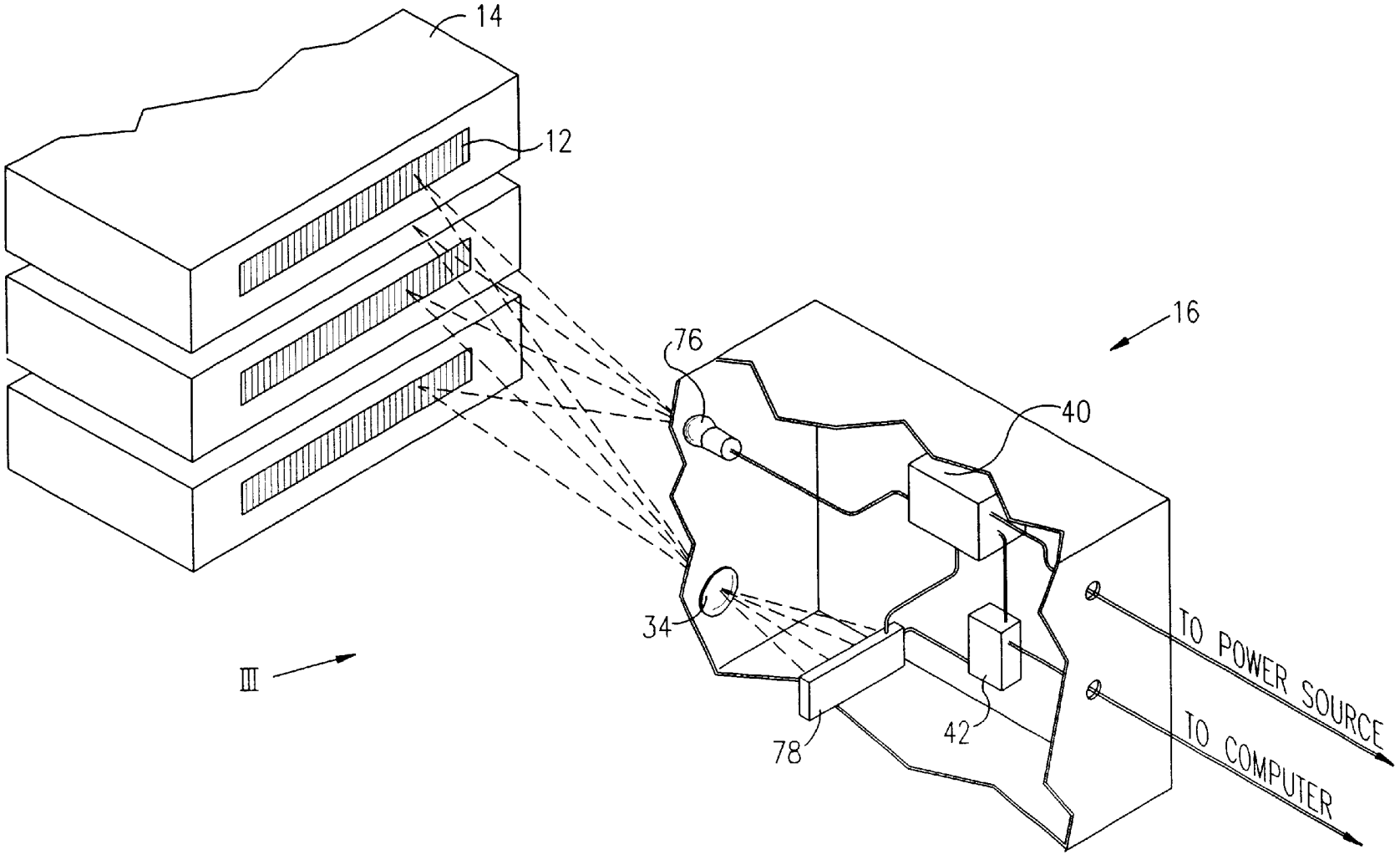
FIG. 12 is a simplified pictorial illustration of components of the exercise tracking system of FIG. 1 in a single-detector implementation constructed and operative in accordance with another preferred embodiment of the present invention.

Reference is now made to FIG. 12 which is a simplified pictorial illustration of components of the exercise tracking system of FIG. 1 in a single-detector implementation constructed and operative in accordance with another preferred embodiment of the present invention. The embodiment of FIG. 12 is generally similar to the embodiment of FIG. 2 with the exception that a light source 76, preferably infrared, and a light detector CCD 78 are provided. CCD 78 may be any array CCD or line CCD known in the art. A line CCD comprising a single vertical line of diodes may be preferable for single-axis movement analysis of weights 14, such as horizontal or vertical-only movement, while an array CCD comprising an array of diodes may be preferable for two-dimensional movement analysis, such as in free weight lifting. CCD 78 receives light reflections from each weight in its field of view. The signal outputs of CCD 78 may be analyzed to determine the absolute position of the weights 14. By comparing the outputs of CCD 78 at various times exercise measurements such as direction of weight movement, displacement, speed, acceleration, deceleration, and force may be calculated using known techniques.

Figure 13:
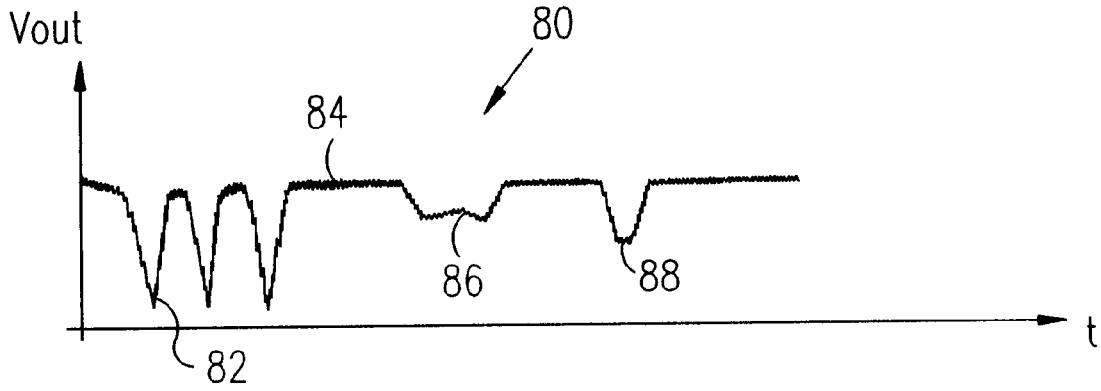
FIG. 13 is a simplified graphical illustration showing a typical output signal from a single vertical line of diodes of CCD 78 of FIG. 12.

Additional reference is now made to FIG. 13 which shows a typical output signal 80 from a single vertical line of diodes of CCD 78 where an axis labeled $V_{out}$ represents the signal strength and an axis labeled t represents the integration time for the line of CCD elements. A low signal value such as at 82 indicates a greater accumulation of light such as would be received at a diode receiving a reflection from a weight, whereas a high signal value such as at 84 indicates a lesser accumulation of light where little or no reflected light is received from a weight. Signal values such as at 86 and 88 resulting from stray light or other reflections from sources other than weights 14 may be factored out by comparing them to a known signal value for a weight reflection or by using other known filtering techniques.

Figure 14A:
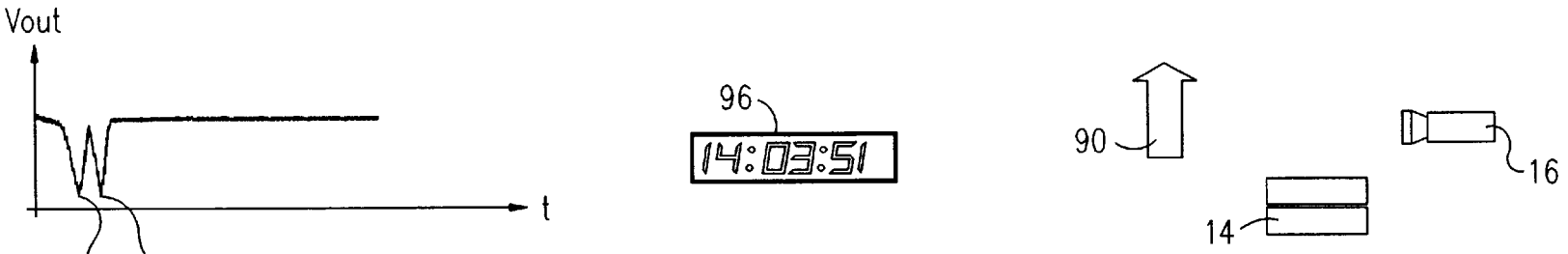
Figure 14B:
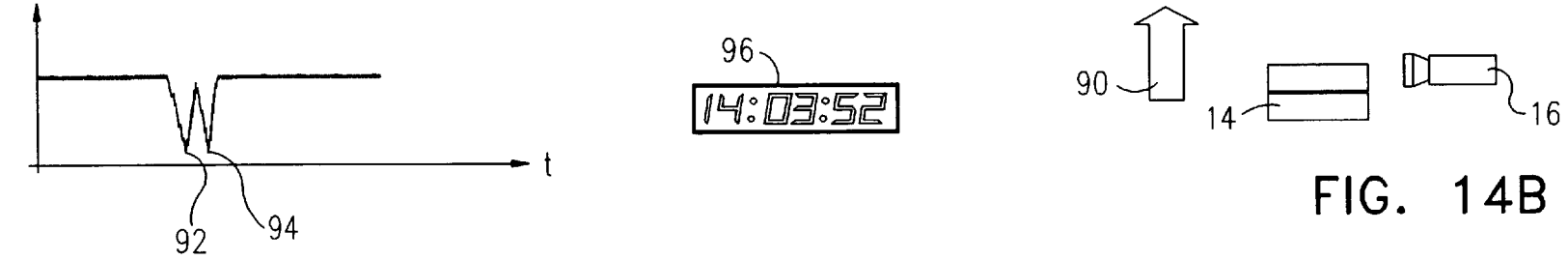
Figure 14C:
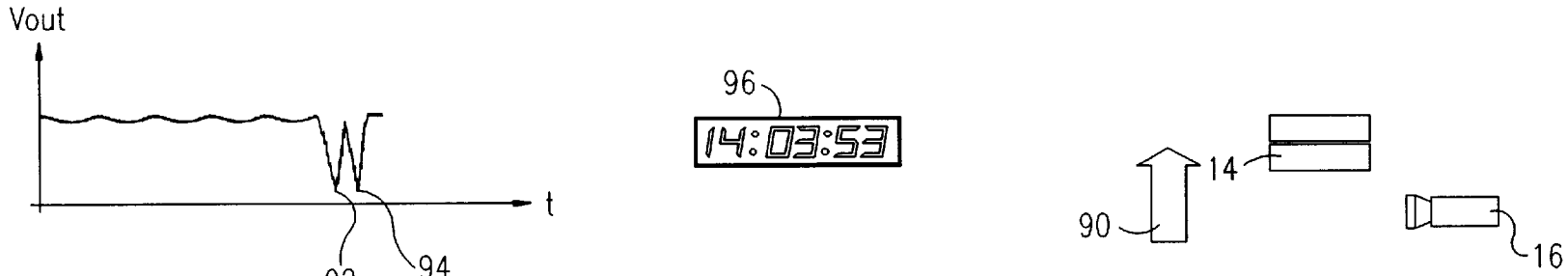

Additional reference is now made to FIGS. 14A–14D which are simplified semi-pictorial semi-block diagrams showing a typical series of output signals from a single vertical line of diodes of CCD 78 as weights 14 move within the field of view of detector 16 which houses CCD 78 (FIG. 13). An arrow 90 indicates the direction in which weights 14 move relative to detector 16. Low signal values 92 and 94 correspond to the reflections of the two weights 14 shown. FIG. 14A shows weights 14 in their initial position. As the weights 14 move past detector 16 in direction of arrow 90 low signal values 92 and 94 "move" correspondingly. The relative positions of the low signal values 92 and 94 may be compared to derive the distance traveled by weights 14 and their range of movement. The weight position change is typically translated to a time integration shift in the sensor's output signal, which is then measured and translated into an exact weight. By capturing output signals at different times through the use of a clock 96, the speed, acceleration, and deceleration of weights 14 may be derived using known techniques. Where the weight of each weight 14 is known, an exercise force may be calculated using known techniques as a function of the known resistance of weights 14 to force together with the movement-related exercise measurements of speed, acceleration, and deceleration such as is shown in FIG. 14D. The number of weights being moved, as expressed as the number of reflections counted, may be multiplied by a predetermined weight value for a single weight to calculate a total load. The position of the weight stack may also be determined by using a weight reflection, typically the lowest weight/first reflection or the highest weight/last reflection, as a reference point. The speed at which the weights are being moved may be calculated by subtracting the previous weight stack position from the current weight stack position to determine an absolute distance traveled, by subtracting the time of the previous weight stack position measurement from the time of the current weight stack position measurement to determine an absolute time of travel, and by dividing the distance traveled by the time of travel. Acceleration may be determined by comparing speed measurements.

Figure 15:
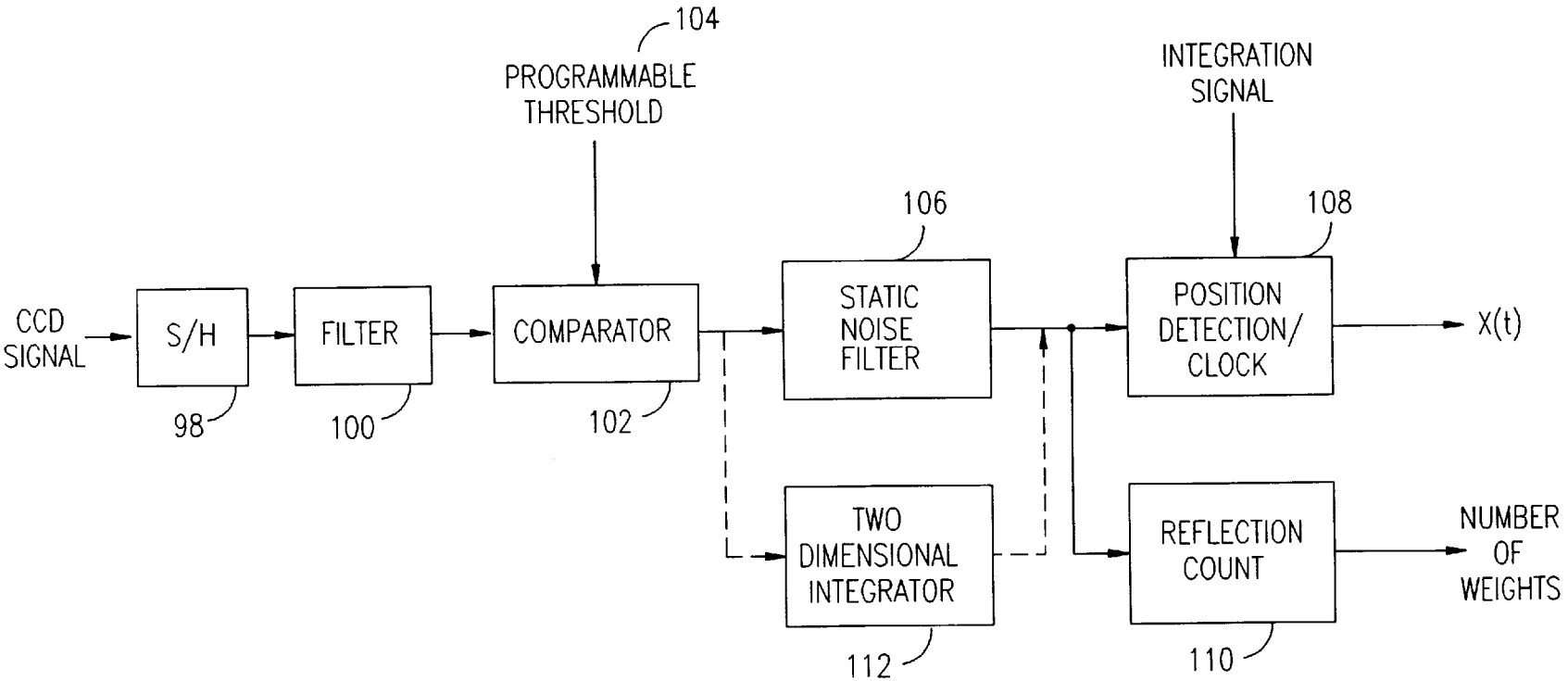
FIG. 15 is a simplified block diagram of a CCD output signal processor useful with the single-detector implementation of FIG. 12, constructed and operative in accordance with a preferred embodiment of the present invention.

Reference is now made to FIG. 15 which is a simplified block diagram of a CCD output signal processor constructed and operative in accordance with a preferred embodiment of the present invention. In the embodiment shown a CCD output signal is received at a sample and hold circuit 98 which may be built in to the CCD device. The output from the sample and hold circuit 98 is filtered by a low-pass filter 100 to reduce noise and spikes that might produce false signals. The filtered signal is then compared at a comparator 102 to a programmable reference voltage threshold 104 which may be used to overcome excessive input noise. Comparator 102 compares the filtered signal to the threshold and produces a logic level signal, which is typically high for each input signal that exceeds the threshold signal. The logic signal is passed to a static noise filter 106 which is used to eliminate any signal of a static nature, i.e. that does not "move" as described with reference to FIGS. 14A–14C. Static filtering is preferably performed by comparing the current CCD output signal to a previously received signal and eliminating pulses that have not changed their position along the integration axis. A position detector 108 preferably analyzes the output of the static noise filter 106 to calculate the position of the low signal values/reflections. The position is determined by measuring the time between an integration signal and the low signal values of the CCD output signal using an internal clock. The output of position detector 108 is typically expressed as a time value X(t) for the reference reflection. From this value the speed, velocity, acceleration, deceleration, range of motion of the weights may be calculated. A reflection counter 110 preferably calculates the total number of weights by counting the number of moving reflections in each CCD output signal. This number may be multiplied by a known weight of each weight plate to derive a total weight amount lifted. This may in turn be combined with the weight's speed or other motion characteristics to determine force, work, etc. It is appreciated that elements of FIG. 15 may be physically and/or functionally incorporated into CCD 78, processor 42 (FIG. 12) or computer 28 (FIG. 1), or in any suitable combination thereof using conventional techniques.

Where an array CCD (two-dimensional CCD) is used, a two-dimensional integrator 112 is preferably used to detect a movement path of weights 14 in the array of received signals and derive a single chain of reflections, typically by performing an axis rotation. When measuring two-dimensional movement, the position detector 108 becomes a two-dimensional position detector which produces both the X(t) position and a Y(t) position of each reflection using known techniques.

Figure 16:
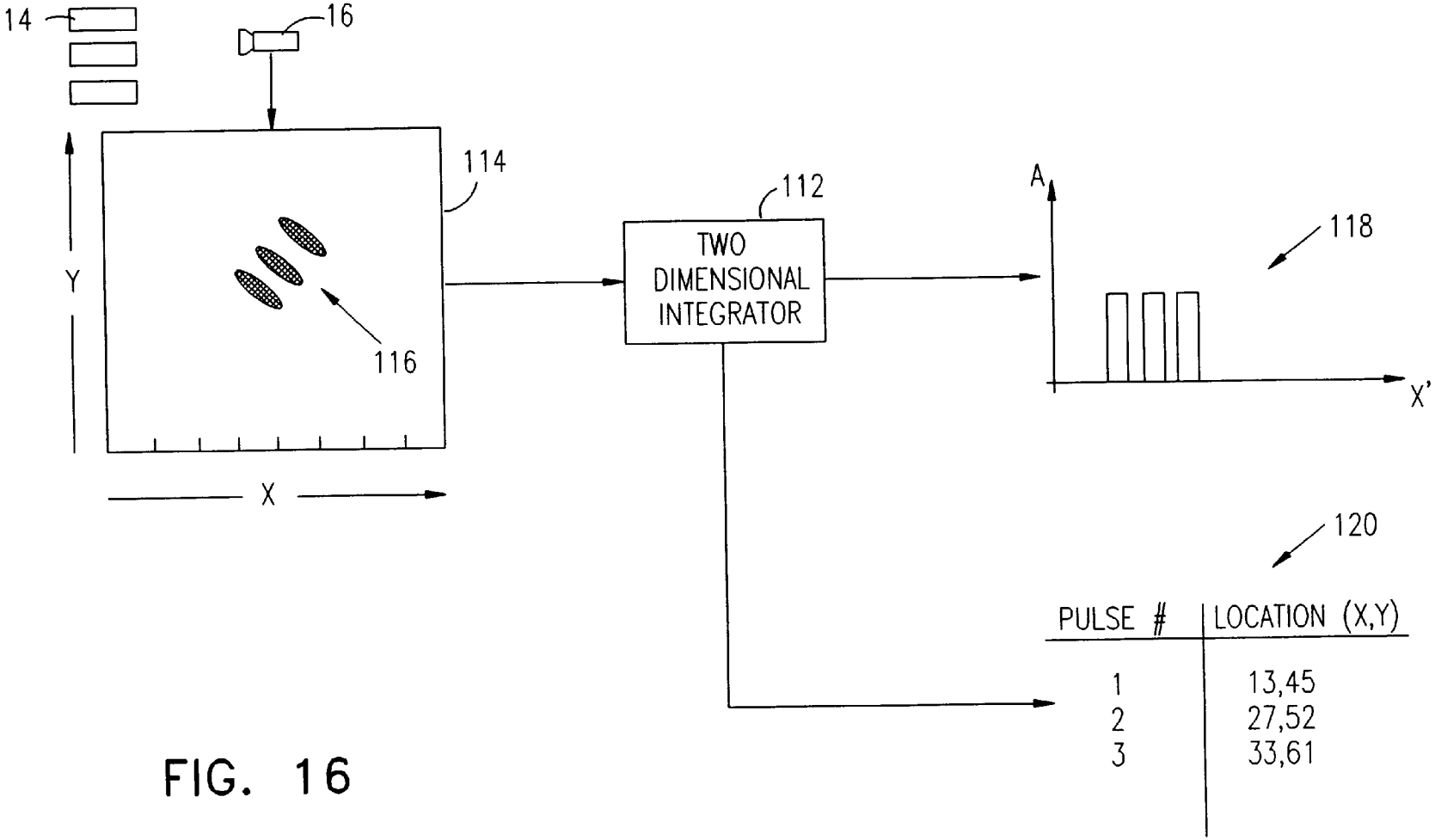
FIG. 16 is a simplified semi-pictorial semi-block diagram showing a typical operation of two dimensional integrator 112 of FIG. 15 upon two-dimensional CCD output.

FIG. 16 is a simplified semi-pictorial semi-block diagram showing a typical operation of two dimensional integrator 112 of FIG. 15 upon two-dimensional CCD output. An XY matrix 114 shows two-dimensional CCD output after digitization, with reflections from the weights 14 shown at 116. Two dimensional integrator 112 is preferably configured to discern both movement along a single axis as well as movement along two axes.

For movement along a single axis two dimensional integrator 112 converts the axis of the XY matrix 114 through a mathematical rotation of the matrix to translate the movement into one-dimensional movement. A row or column in the translated matrix for which the CCD signals, and therefore the reflections, are the strongest may be chosen to produce a digital output signal 118 corresponding to that of a line CCD after processing by comparator 102 of FIG. 15.

For movement along two axes two dimensional integrator 112 produces a list 120 of peak reflection locations in the form of pulse number, starting with the pulse closest either the X or Y axes, and the X Y location of the pulse. This list may be used to compute the absolute weight movement using a vector calculation where distance from reference position is calculated by Dist=sqrt(X*X+Y*Y).

It is appreciated that the steps of the methods described hereinabove need not necessarily be performed in a particular order, and that in fact, for reasons of implementation, a particular implementation of the methods may be performed in a different order than another particular implementation.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow:

1. An exercise tracking system comprising:

at least one exercise apparatus including multiple elements which may move independently of each other;

a CCD camera arranged to simultaneously view plural ones of said multiple elements of said exercise apparatus and to provide an output indication of movements of said multiple elements; and a computer employing said output indication to compute exercise parameters based on said movements of said multiple elements of said exercise apparatus.

2. An exercise tracking system according to claim 1 and further comprising a light source arranged to interact with light interaction members mounted on ones of said multiple elements of said exercise apparatus.

3. An exercise tracking system according to claim 2 wherein said light source is arranged to impinge light on said light interaction member.

4. An exercise tracking system according to claim 2 wherein said exercise apparatus is operative to selectively position said light interaction member within and without a field of view of said detector.

5. An exercise tracking system according to claim 4 wherein said exercise apparatus is further operative to cyclically position said light interaction member within and without said field of view.

6. An exercise tracking system according to claim 2 wherein said at least one light interaction member comprises a plurality of light interaction members.

7. An exercise tracking system according to claim 6 wherein at least two of said plurality of light interaction members are of different dimensions.

8. An exercise tracking system according to claim 1, wherein said exercise apparatus comprises a weight.

9. An exercise tracking system according to claim 1, and further comprising a display.

10. An exercise tracking system according to claim 1, and further comprising user identification apparatus.

11. An exercise tracking system according to claim 10 wherein said user identification apparatus comprises a smart card.

12. An exercise tracking system according to claim 10 wherein said user identification apparatus comprises a magnetic stripe card.

13. An exercise tracking system according to claim 10 wherein said user identification apparatus comprises a card reader.

14. An exercise tracking system according to claim 10 wherein said user identification apparatus comprises a keypad.

15. An exercise tracking system according to claim 10 wherein said user identification apparatus comprises a card writer.

16. An exercise tracking system according to claim 1, and further comprising audio output apparatus.

17. An exercise tracking system according to claim 2, wherein any of said light interaction members are arranged to identify said exercise apparatus.

18. An exercise tracking system according to claim 2, wherein said light interaction member comprises a reflector.

19. An exercise tracking system according to claim 2, wherein said light interaction member comprises a tab.

20. An exercise tracking system according claim 19 wherein said tab is of sufficient opacity such that said light interaction thereat is not detectable by said detector.

21. A method for measuring exercise, the method comprising:

producing at least one light interaction with an exercise apparatus including multiple elements which may move independently of each other;

employing a CCD camera arranged to simultaneously view plural ones of said multiple elements of said exercise apparatus for detecting said at least one light interaction and to provide an output indication of movements of said multiple elements; and employing said output indication for determining a correlation between said at least one light interaction and at least one exercise characteristic, thereby to compute exercise parameters based on said movements of said multiple elements of said exercise apparatus.

22. A method according to claim 21 and further comprising moving said exercise apparatus along an apparatus path.

23. A method according to claim 21 wherein said detecting step comprises measuring a duration of said light interaction.

24. A method according to claim 23 and further comprising correlating said duration with an identity of said exercise apparatus.

25. A method according to claim 23 and further comprising correlating said duration with a speed of said exercise apparatus.

26. A method according to claim 21, wherein said detecting step comprises measuring at least one time interval between a plurality of light interactions.

27. A method according to claim 26 and further comprising correlating said measurement with a speed of said exercise apparatus.

28. A method according to claim 21, wherein said producing step comprises producing a light reflection.

29. A method according to claim 21, wherein said producing step comprises producing a light strobed light.

30. A method for measuring exercise, the method comprising:

providing light reflections from an exercise apparatus including multiple elements which may move independently of each other;

employing a CCD camera arranged to simultaneously view plural ones of said multiple elements of said exercise apparatus for detecting said light reflections from said exercise apparatus and to provide an output indication of movements of said multiple elements; and employing said output indication for determining at least one light exercise measurement from a comparison of said light reflections, thereby to compute exercise parameters based on said movements of said multiple elements of said exercise apparatus.

31. A method according to claim 30 wherein:

a providing step comprises detecting said first light reflection at a first time detecting a second light reflection step comprises detecting said second light reflection a second time later than said first time.

32. A method according to claim 30 wherein said determining step comprises determining an extent of displacement of said exercise apparatus.

33. A method according to claim 30 wherein said determining step comprises determining a direction of movement of said exercise apparatus.

34. A method according to claim 30 wherein said determining step comprises determining a speed of said exercise apparatus.

35. A method according to claim 30 wherein said determining step comprises determining an acceleration of said exercise apparatus.

36. A method according to claim 30 wherein said determining step comprises determining a deceleration of said exercise apparatus.

37. A method according to claim 30 wherein said determining step comprises determining a movement-related exercise measurement and calculating an exercise force from a predetermined resistance of said exercise apparatus to force and said exercise measurement.

* * * * *